US008733980B2

(12) United States Patent
Cook

(10) Patent No.: US 8,733,980 B2
(45) Date of Patent: May 27, 2014

(54) LED LIGHTING MODULES AND LUMINAIRES INCORPORATING SAME

(75) Inventor: William V. Cook, Winter Haven, FL (US)

(73) Assignee: Wyndsor Lighting, LLC, Winter Haven, FL (US)

( * ) Notice: Subject to any disclaimer, the term of this patent is extended or adjusted under 35 U.S.C. 154(b) by 1144 days.

(21) Appl. No.: 12/576,649

(22) Filed: Oct. 9, 2009

(65) Prior Publication Data

US 2011/0063843 A1 Mar. 17, 2011

Related U.S. Application Data

(63) Continuation-in-part of application No. 12/559,075, filed on Sep. 14, 2009, now Pat. No. 8,197,098, and a continuation-in-part of application No. 29/343,692, filed on Sep. 17, 2009, now Pat. No. Des. 643,945, and a continuation-in-part of application No. 29/343,695, filed on Sep. 17, 2009, now Pat. No. Des. 644,349.

(51) Int. Cl.
*F21V 29/00* (2006.01)

(52) U.S. Cl.
USPC ..... 362/294; 362/249.02; 362/373

(58) Field of Classification Search
USPC ..... 362/218, 249.02, 294, 373, 362, 431
See application file for complete search history.

(56) References Cited

U.S. PATENT DOCUMENTS 6,213,622 B1 4/2001 Shimada et al.
6,250,774 B1 6/2001 Begemann et al.
6,416,200 B1 7/2002 George
6,517,221 B1 2/2003 Xie
6,784,357 B1 8/2004 Wang
6,910,794 B2 6/2005 Rice
6,942,361 B1 9/2005 Kishimura et al.
6,976,769 B2 12/2005 McCullough et al.
7,095,110 B2 8/2006 Arik et al.
7,121,687 B2 * 10/2006 Sidwell et al. ..... 362/249.02
7,210,832 B2 5/2007 Huang
7,314,291 B2 1/2008 Tain et al.
7,329,030 B1 2/2008 Wang
7,331,691 B2 2/2008 Livesay et al.
7,413,326 B2 8/2008 Tain et al.
7,438,440 B2 10/2008 Dorogi
7,438,449 B2 10/2008 Lai et al.
7,467,878 B2 12/2008 Li
7,488,093 B1 2/2009 Huang et al.
7,494,248 B2 2/2009 Li
7,505,268 B2 3/2009 Schick
7,540,636 B2 6/2009 Lai et al.
7,540,761 B2 6/2009 Weber et al.
7,547,124 B2 6/2009 Chang et al.

(Continued)

*Primary Examiner* — Y My Quach Lee
(74) *Attorney, Agent, or Firm* — GrayRobinson PA

(57) ABSTRACT

LED lighting modules have a highly thermally conductive polyhedral body having a plurality of exterior facets disposed around a mounting axis in a polygonal array facing outwardly away from the mounting axis and at a downward angle thereto. At least a majority of the facets carries at least one LED whose optical axis is angled acutely. The body carries a plurality of heat dissipating fins and serves as a heat sink to prevent overheating the LEDs in a transient and steady state operation. For retrofit applications, the module is mounted to a fixture via either a support or a bracket in a mounting position in which the elevation of the LEDs is determined according to the mounting and geometry of the replaced lamp.

36 Claims, 15 Drawing Sheets

(56) References Cited

U.S. PATENT DOCUMENTS

| | | | | |
|---|---|---|---|---|
| 8,021,025 | B2 * | 9/2011 | Lee | 362/363 |
| 8,109,660 | B2 * | 2/2012 | Hochstein et al. | 362/373 |
| 8,262,261 | B2 * | 9/2012 | Rossi | 362/294 |
| 8,274,241 | B2 * | 9/2012 | Guest et al. | 362/294 |
| 2009/0086491 | A1 | 4/2009 | Ruud et al. | |
| 2009/0103294 | A1 * | 4/2009 | Zhang et al. | 362/294 |
| 2009/0147522 | A1 | 6/2009 | Shuai et al. | |
| 2009/0168416 | A1 | 7/2009 | Zhang et al. | |

* cited by examiner

LED LIGHTING MODULES AND LUMINAIRES INCORPORATING SAME

CROSS-REFERENCE TO RELATED APPLICATIONS

This application claims priority under 35 U.S.C. §120 to, and is a continuation-in-part of U.S. Design patent application Ser. No. 29/343,692 filed Sep. 17, 2009 and U.S. Design patent application Ser. No. 29/343,695, filed Sep. 17, 2009 and U.S. patent application Ser. No. 12/559,075, filed Sep. 14, 2009.

STATEMENT REGARDING FEDERALLY SPONSORED-RESEARCH OR DEVELOPMENT

Not Applicable.

INCORPORATION BY REFERENCE

The disclosures of U.S. Design patent application Ser. No. 29/343,692 filed Sep. 17, 2009 and U.S. Design patent application Ser. No. 29/343,695, filed Sep. 17, 2009 and U.S. patent application Ser. No. 12/559,075, filed Sep. 14, 2009 are each expressly incorporated herein by reference in their entirety to form part of the present application as if fully set forth herein Not Applicable.

FIELD OF THE INVENTION

The invention relates to the field of lighting modules and luminaires for general illumination or architectural illumination of indoor or outdoor areas using light emitting diodes (LEDs). More particularly, the invention relates to retrofitable LED lighting modules for installation in a light fixture as an energy efficient replacement for a conventional lamp and to luminaires incorporating such modules.

BACKGROUND OF THE INVENTION

Conventional incandescent light bulbs have a glass envelope which is evacuated or is filled with an inert gas such as argon and/or nitrogen. A thin filament of tungsten is suspended inside the envelope between a pair of electrical leads. Light is produced by passing an electric current through the filament which is heated by the current passing through it until it glows brightly, a process called "incandescence". Filament temperatures on the order of about 4,500 degrees Fahrenheit (2,500 degrees Celsius) are typical. Incandescent light bulbs are a relatively inefficient way of converting electrical power which is typically measured in Watts, into light which is typically measured in Lumens. The "efficiency" of a lamp is generally expressed according to the amount of visible light the lamp produces as measured in units called "lumens", divided by the electrical power, measured in "watts", required to operate the lamp. A lamp with a high ratio of lumens per watt is more energy efficient than one with a lower output of lumens of light per watt of electrical energy consumed. Of the total amount of electrical energy they consume, incandescent lamps convert a much higher percentage of that energy into heat than visible light. Incandescent lamps also have relatively short normal operating lives. After only about 750 to 1,000 hours enough tungsten evaporates from the filament of an incandescent lamp that the filament can no longer support its own weight, causing the lamp to "burn out" as a result of breakage of the filament.

A halogen lamp is an improved type of incandescent lamp. Its tungsten filament is enclosed in a low-volume, gas-filled envelope of quartz. The envelope and the filament are so close to one another that the envelope would melt if it were of ordinary glass. The gas within the envelope is a halogen. At the high normal operating temperatures of a halogen lamp, the gas combines with tungsten that has vaporized off the filament and re-deposits the tungsten back onto the filament, thus both lengthening its life allowing the filament to operate at a significantly higher temperature and thus glow more brightly than an ordinary incandescent bulb. As a result, halogen lamps produce more useful light per unit of electrical power applied to the lamp, i.e. more lumens per watt than a normal incandescent lamp. However, due to their high operating temperature, halogen lamps also waste a large amount of energy that is given off as heat.

Gas discharge lamps of various kinds are also well-known in the prior art. These too include a gas-filled envelope but not have a filament. A fluorescent lamp one type of gas discharge lamp that is widely used. The glass envelope in fluorescent lamp is a typically a glass tube. A small amount of mercury and an inert gas, such as argon, are sealed inside the tube under very low pressure. The inside wall of the tube is coated with a phosphor powder. Each one of a pair of electrodes located at opposite ends inside the tubular glass envelope is wired to a fixture which contains an electrical circuit called a "ballast" that generates a high voltage between the electrodes. That voltage causes electrons to flow through the gas between the electrodes and vaporizes the mercury in the tube. Electrons and mercury atoms collide, raising electrons to higher energy levels. Photons are released as the electrons return to a lower original energy level following those collisions thereby creating light, much of it being invisible ultraviolet ("UV") light, rather than useful visible light. However, when these photons strike the phosphor coating inside the tube, the phosphor coating releases light within the visible range of the spectrum through a process called "phosphorescence." Because they convert what would otherwise be invisible UV light into useful visible light, fluorescent lamps are typically much more energy efficient than incandescent lamps.

LEDs produce light by a completely different mechanism than incandescent or gas discharge lamps. An LED is a semiconductor device, namely a diode junction between a p-type semiconductor material and n-type semiconductor material. As an electric current is passed in the forward direction across the p-n junction of an LED, photons are given off as electrons making up the flow of current change their energy levels, thus producing light. This process, called electroluminescence, is an efficient way of generating light from electricity, particularly in comparison to incandescent bulbs and many other types of lamps. However, it is not a process which results in 100% conversion of electrical energy into light. A significant fraction of the energy represented by the electric current flowing through an LED generates heat rather than light. If sufficient amounts of heat are not carried away from the area of the p-n junction at a sufficient rate, the operating temperature of the LED can quickly rise to an unacceptably high temperature which could cause the LED to fail prematurely. Thus, unlike incandescent bulbs and certain other technologies such as high intensity discharge (HID) lamps, which not only tolerate, but actually require, extreme temperatures in order to generate light, LEDs are relatively intolerant of high temperatures, particularly if one desires to maximize the operating life if the LED.

Early LED devices were not capable of producing light in amounts sufficient for general illumination or architectural illumination. They were used mainly as glowing indicators in electronic and consumer devices. However, as a result of advancements in LED technology, LEDs of sufficient light output for flashlights, lanterns and even general and architectural lighting devices have now been available for several years and the technology continues to advance providing new generations of LEDs having greater lumen output, higher efficiency and lower cost than earlier generations. There has been considerable interest in developing LED lighting modules and luminaires which exploit these improvements in LED technology to provide energy cost savings in general and architectural lighting applications. The enormous investment represented by luminaires and light fixtures which are already existing and installed in the field were designed for operation with an incandescent, fluorescent, gas discharge or other conventional type of lamp, has generated considerable interest in developing LED lighting devices which incorporate high intensity LEDs and can be retrofitted into an existing style of light fixture or luminaire as a substitute for a replaced lamp of some other type. However, due in significant part to the inherent intolerance of high temperatures which is characteristic of LEDs, such efforts have met with only limited success.

One approach has been to provide LED luminaires with substantial vent openings which allow air exchange between the interior of the luminaire and the external environment. While vent opening are frequently present in many existing fixtures or luminaires, their sizes and locations are typically not adequate to provide sufficient air exchange to avoid overheating LEDs to a point which at least shortens their operating life. Enlarging and/or relocating vent openings to provide more air flow is not always possible or desirable. By their nature, vent openings can allow for intrusion of dirt, water and/or insects which can damage a fixture or reduce its light output.

As exemplified for example by U.S. Pat. Nos. 7,438,440 and 7,494,248 another approach to dealing with the heat sensitivity of LEDs in luminaires and light fixtures for general and architectural lighting applications has been to connect one or more heat pipes in a thermal path between one or more of the LEDs and a heat sink located exterior to the housing of the fixture or luminaire so as to conduct heat rapidly away from the LED to the external environment. While effective from a thermal management standpoint, fixtures and luminaires constructed in this manner tend to be bulky, complex and relatively expensive to manufacture. Space constraints and the need to modify an existing fixture or luminaire to accommodate the routing of heat pipes make such an approach less than ideal for retrofit applications.

SUMMARY OF THE INVENTION

According to a preferred embodiment, an LED lighting module has a polyhedral body having a plurality of downwardly angled facets disposed in a polygonal array around a mounting axis. At least one LED is supportedly mounted to each respective one of a majority of the facets, each LED having an optical axis oriented at an acute angle with respect to the mounting axis. A plurality of heat dissipating fins are supportably mounted to the body and thermally conductively coupled thereto. According to certain embodiments, an active cooling device is mounted in a recess formed among the fins. The active cooling device may preferably comprise a device of the type which includes a plurality of nozzles each of which discharge successive jets of turbulent pulses to enhance heat transfer from the fins. According to certain embodiments, the body of the module is suspended in its operating position by a mounting bracket while in other embodiments, the body of the module is mounted on a support which preferably also includes a plurality of heat dissipating fins. According to a further aspect of the invention, a light shield having a reflective surface may extend outwardly from one or more of the facets to block at least some light emitted by the LEDs in a skyward direction and redirect same in a downward direction. According to another aspect of the invention, the polyhedral body has sufficient thermal mass, and the LEDs are coupled to the polyhedral body by way of thermally conductive paths of sufficiently low thermal resistance that during the thermal lag period which occurs between the time the LEDs are initially energize and such later time as heat drains from the polyhedral body at a rate at least as raid as that at which heat enters the body from the LEDs, the polyhedral body is capable of taking on heat from the LEDs at a sufficiently high rate of heat flow to prevent overheating of the LEDs.

Further aspects of the invention relate to the elevational positioning of the module with reference to the actual or intended positioning of a lamp which the module replaces or is to be used in lieu of. According to one such aspect, an LED module to be used in a fixture or luminaire instead of a replaced lamp in a base-up orientation, the operating position of the module is such that the center of at least some of the LEDs are positioned at an elevation which substantially corresponds to a midpoint of the major dimension of the envelope of the replaced lamp or at least within a range which is centered about such midpoint and extends over not more than about twenty five percent (25%) of the major dimension of the envelope of the replace lamp.

According to embodiments in which module 10 is to be used in lieu of a horizontally mounted replaced lamp, the centers of at least some of the LEDs are positioned at an elevation which substantially corresponds to the central axis of the envelope of the replaced lamp.

According to embodiments in which module 10 is to be used in lieu of a lamp oriented base-down, the mounting bracket or support, as the case may be, positions the polyhedral body such that the centers of at least some of the LEDs on the facets are positioned at an elevation which substantially corresponds to the elevation of the top of the envelope of the replaced lamp or at some lower elevation lying no further below the elevation of the top of the envelope of the replaced lamp than a distance of twenty five percent (25%) of the major dimension of the envelope of the replaced lamp.

These and other objects of the invention will be clear to a person of ordinary skill in the art in light of the following written description of preferred embodiments and the drawings in which corresponding items are designated by corresponding reference numerals.

BRIEF DESCRIPTION OF THE DRAWINGS

Preferred embodiments of the invention will be described in further detail below with reference to the following drawings in which.

DETAILED DESCRIPTION OF PREFERRED EMBODIMENTS

Figure 1:
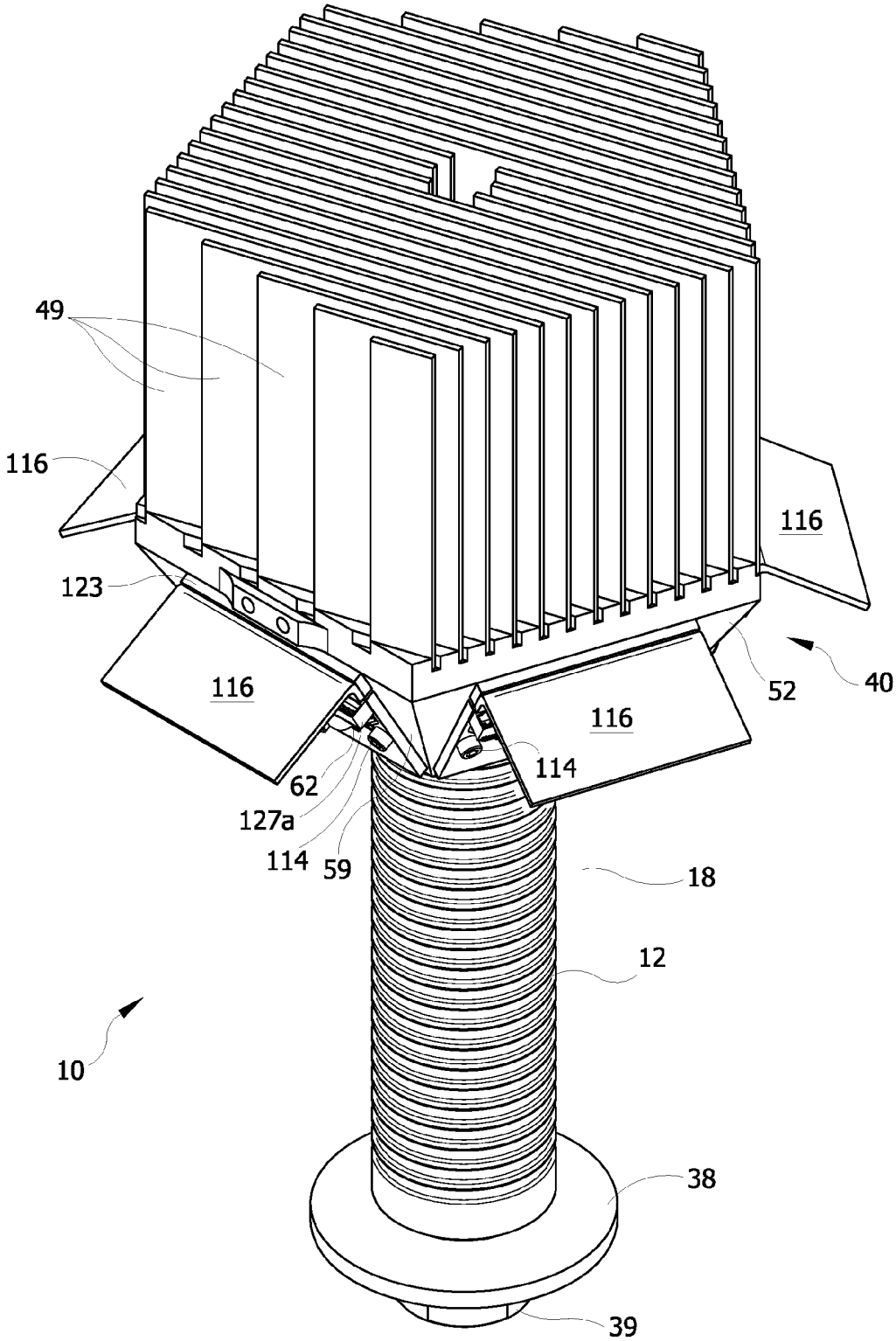
FIG. 1 is a perspective view of a first preferred embodiment of an LED lighting module according to the invention.

Referring collectively to FIGS. 1 through 5, a first preferred embodiment of an LED lighting module 10 constructed according to the present invention includes an elongated, hollow, support 12 having an externally threaded upper end 14 and an externally threaded lower end 16 which are separated from one another by an unthreaded middle portion 18 which terminates in an upper collar 20 and a lower collar 22. Extending radially outwardly from middle portion 18 are a plurality of heat dissipating fins 28, which are separated from one another by spaces 30 located therebetween to facilitate the transfer of heat from support 12 to the air which contacts fins 28. The hollow interior of support 12 forms a first passage 32 of adequate cross sectional area to allow at least one or more electrical conductors 33, 34 to be safely routed internally through the entire length of support 12 by way of first passage 32 for grounding, powering and/or controlling module 10. First passage 32 protects the conductors 33, 34 from mechanical damage and excessive temperatures and conceals the conductors 33, 34 from view from the exterior of a light fixture 36 to which module 10 has been installed, either originally, or as a replacement for a lamp and lampholder which have been removed or in lieu of which module 10 is being used. In either case, such lamp is referred to hereinafter for the sake of convenience as a "replaced lamp."

Figure 2:
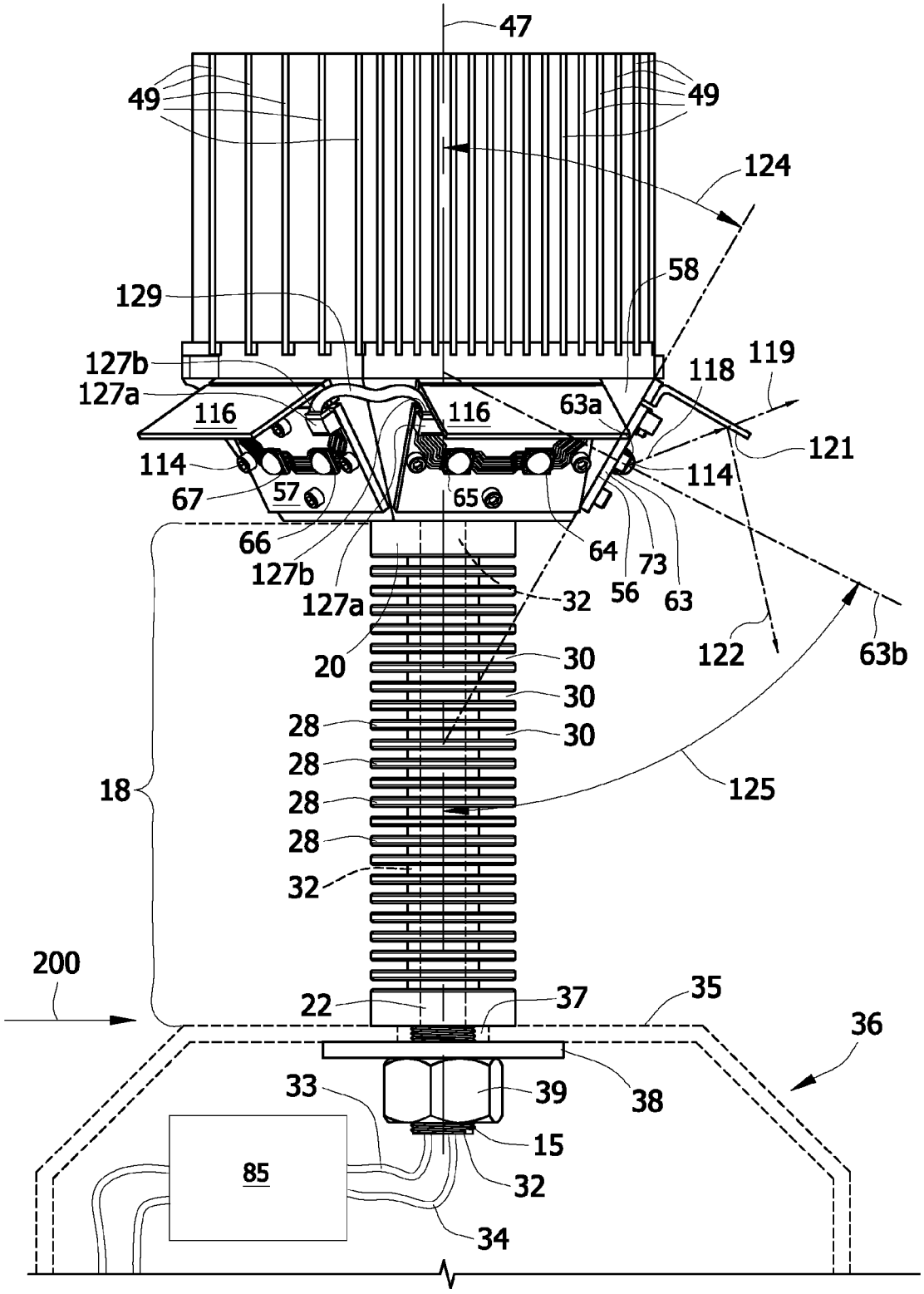
FIG. 2 is a side elevational view of the embodiment of FIG. 1.

Module 10 is mounted in an installed position to a housing 35 of a light fixture 36 by way of support 12. As illustrated in FIG. 2, in the preferred embodiment this is achieved by passing the threaded lower end 15 of support 12 through an opening 37 in light fixture 36 and mechanically coupling the support 12 to the housing 36 by clamping a portion of the housing 35 between lower collar 22 and a washer 38 under pressure exerted by a threaded fastener 39, such as a conventional nut, a "Tinnerman" fastener or the like. Alternatively, module 10 can be secured to fixture 36 with a snap ring could be applied to engage a groove (not shown) formed in the lower end of 15 of support 12. Yet another alternative is to secure collar 22 to housing 35 using one or more rivets, screws, bolts or other suitable mechanical fasteners (not shown) or by welding, brazing, soldering or adhesive bonding.

Support 12 is formed of a highly thermally conductive material such as aluminum, copper or an alloy such as brass. Support 12 could be suitably be assembled by joining two or more separate component parts but for best heat transfer, mechanical strength and visual appearance, support 12 is preferably fabricated as unitary structure formed from a single piece of highly thermally conductive material. In the preferred embodiment support 12 is machined from a single block of T-6061 aluminum alloy which, after machining, is polished and anodized to resist oxidation and provide an attractive appearance. Support 12 could alternatively be formed as an aluminum or zinc die casting, sand casting or investment casting of brass or other copper alloy, drilled or otherwise hollowed to form first passage 32. Support 12 could be formed by pressing a quantity of powdered metal or a composite material into shape and sintering it to fuse the powder into an integrated structure or in any of a variety of other ways which will become apparent to a person of ordinary skill in the art in light of the disclosure set forth herein and in the drawings.

Module 10 further includes a polyhedral body 40 which has a mounting axis 47 and is supportably mounted to the upper end 15 of support 12. In the preferred embodiment, mounting axis 40 happens to be oriented vertically and coincides with the central longitudinal axis of support 12. It is to be understood however, that the orientation of the mounting axis 47 and the orientation of the support 12 and the geometry and manner according to which it is joined to body 40 can be varied to best suit the needs of a given application. It is also to be understood that support 12 is not limited to a columnar, or post-like configuration or any particular shape. Support 12 could, by way of nonlimiting example, alternatively be formed as a tripod or as a bifurcated member of a generally upright, or inverted letter "Y"-shaped member or assembly of members. Also, body 40 need not be supported solely by support 12. Support of body 40 can be carried out with the aid of one or more additional supports 12 and/or other members without departing from the scope of the invention.

Body 40 has an underside 42, the center of which is penetrated by a female threaded opening which mates with the threaded upper end 15 of support 12 to securely mechanically couple body 40 and support 12 to one another and thermally and conductively couple body 40 and support to one another so there is, at most, little thermal resistance between them. In addition to a substantial mating surface area present between body 50 and support 12 at the interface of the male threads carried by the upper end 14 of support 12 and the female threads of opening 52, the upper collar 20 of support 12 has a flat, smooth, upper surface 43 which abuts a mating portion of the underside 42 of body 50 over a relatively large area and thus serves to even further reduce the thermal resistance between support 12 and body 50. If desired, a heat transfer enhancing agent, such as thin layer (not shown) of thermally conductive paste of the type commonly used for mounting semiconductor packages on circuit boards, may be interposed between the underside 42 of body 40 and the upper surface 43 of upper collar 20 to reduce the thermal resistance between body 40 and support 12 by filling any small gaps, which may exist therebetween.

Polyhedral body 40 is formed of a highly thermally conductive material which, in order to avoid galvanic corrosion and/or loosening due to differences in thermal coefficients of expansion, is preferably of the same material as support 12. Accordingly, in the preferred embodiment, body 40 is fabricated by machining from a single block of T-6061 aluminum alloy and is polished and anodized after machining. Body 40 could also be formed from brass or other alloys of copper or other alloys and could suitably be fabricated using any of the alternative fabrication techniques mentioned above in connection with the fabrication of support 12.

Body 40 has sufficient thermal mass, and the thermal paths 90-99 by way of which LEDs 60-69 are thermally conductively coupled to body 40 are of sufficiently low thermal resistance, to keep the temperature of LEDs 60-69 acceptably low during the transient thermal lag period which occurs between the time any or all of LEDs 60-69 are first energized and such later time that the temperature of body 40 stops rising as a result of heat being shed from body 40 by any combination of thermal conduction convection and/or, radiation, either directly from body 40 itself or by way of one or more other components of module 10 such as heat dissipating fins 28 and/or 49 and light shields 116.

A plurality of heat dissipating fins 49 are supportably mounted to body 40 and are thermally conductively coupled to polyhedral body 40. In the preferred embodiment, fins 49 take the form of a plurality of mutually spaced, parallel plates having air gaps between them to facilitate the transfer of heat from body 40 to the ambient environment which adjoins fins 49. Fins 49 are preferably of a highly thermally conductive material and are preferably integrally formed with body 40 by being machined from the same piece of stock material from which body 40 itself is fabricated. Alternatively, fins 49 could be formed as separate plates which could be welded, soldered or brazed to body 40 or shrink fitted into parallel slots formed in the top of body 40.

Polyhedral body 40 also includes a plurality of exterior planar facets 55, 56, 57, 58 and 59 which are arranged in a substantially polygonal array 52. Facets 55-59 each face outwardly away from mounting axis 47 and are oriented at a downward angle with respect to mounting axis 47 as shown in FIG. 2. In the preferred embodiment, polygonal array 52 is a pentagonal array whose cross sectional profile is a pentagon 53 which happens to be centered on mounting axis 47 as can be seen for example from FIG. 3. It is to be understood however that embodiments in which body 40 has more than five (5 ea.) facets, or fewer than five (5 ea.) facets, are also within the scope of the present invention, the number of facets being selected primarily based on the overall lighting distribution pattern desired to be projected from module 10.

At least a majority of the total number of downwardly angled facets 55-59 on polyhedral body 40 have at least one light emitting diode (LED) supportably mounted thereon. As used herein and in the claims, the term "LED" is to be broadly construed and includes light emitting diodes made using either organic materials, such as OLEDs and/or PLEDs or inorganic semiconductor, all without limitation as to the particular wavelength or combination of wavelengths of light emitted. The term "LED" also encompasses devices having either an individual light-emitting p-n junction or an array of p-n junctions. The preferred embodiment includes a total of ten (10 ea.) LEDs 60, 61, 62, 63, 64, 65, 66, 67, 68 and 69, pairs of which are mounted on respective circuit boards 71, 73, 75, 77 and 79. Each LED 60-69 in the preferred embodiment is a device which actually includes four (4 ea.) individual LED dies mounted under a common dome-shaped optic 60*a*, 61*a*, 62*a*, 63*a*, 64*a*, 65*a*, 66*a*, 67*a*, 68*a* and 69*a* which projects light in a pattern surrounding a respective optical axis 60*b*, 61*b*, 62*b*, 63*b*, 64*b*, 65*b*, 66*b*, 67*b*, 68*b* and 69*b*. Each of LEDs 60-69 are mounted supportably to, and are thermally conductively coupled to, respective ones of the facets 55-59 of body 40 by way of a thermal path 90-99 of low thermal resistance and high heat carrying capacity. The thermal paths 92 and 93 which thermally conductively link body 40 with LEDs 62 and 63, respectively are schematically represented by broken arrows in the partially exploded view of FIG. 5. While it is to be understood that corresponding thermal paths 90, 91 and 99 exist between body 40 and LEDs 60, 61 and 64-99, respectively, for clarity of illustration only thermal paths 92 and 93 are called out in the drawings, and, since thermal paths 90-99 are alike in all relevant respects in the preferred embodiment, the description will proceed with reference only to thermal path 92 which is typical of its counterparts.

Figure 5:
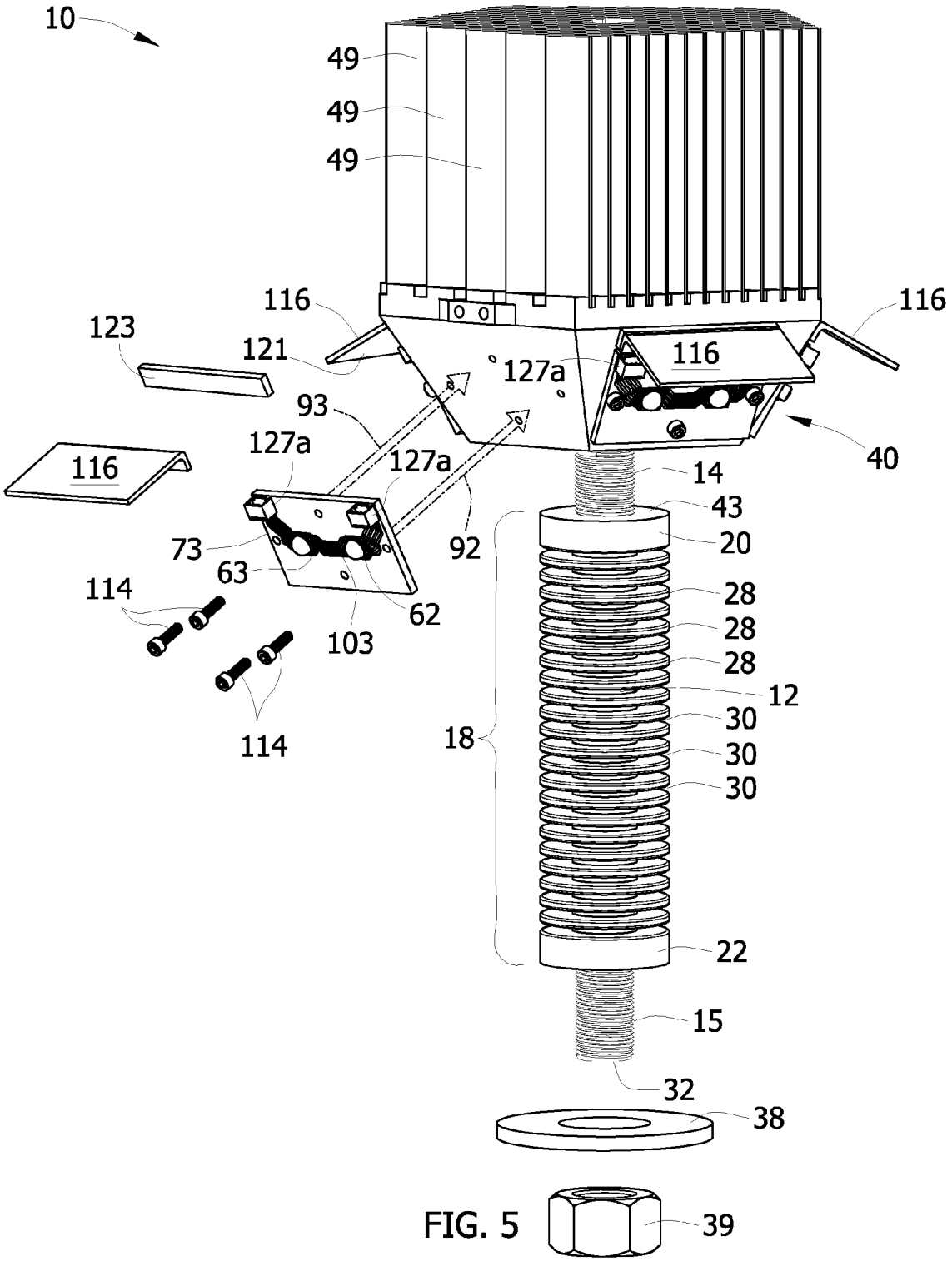
FIG. 5 is a partially exploded perspective view of the embodiment of FIG. 1.
Figure 6:
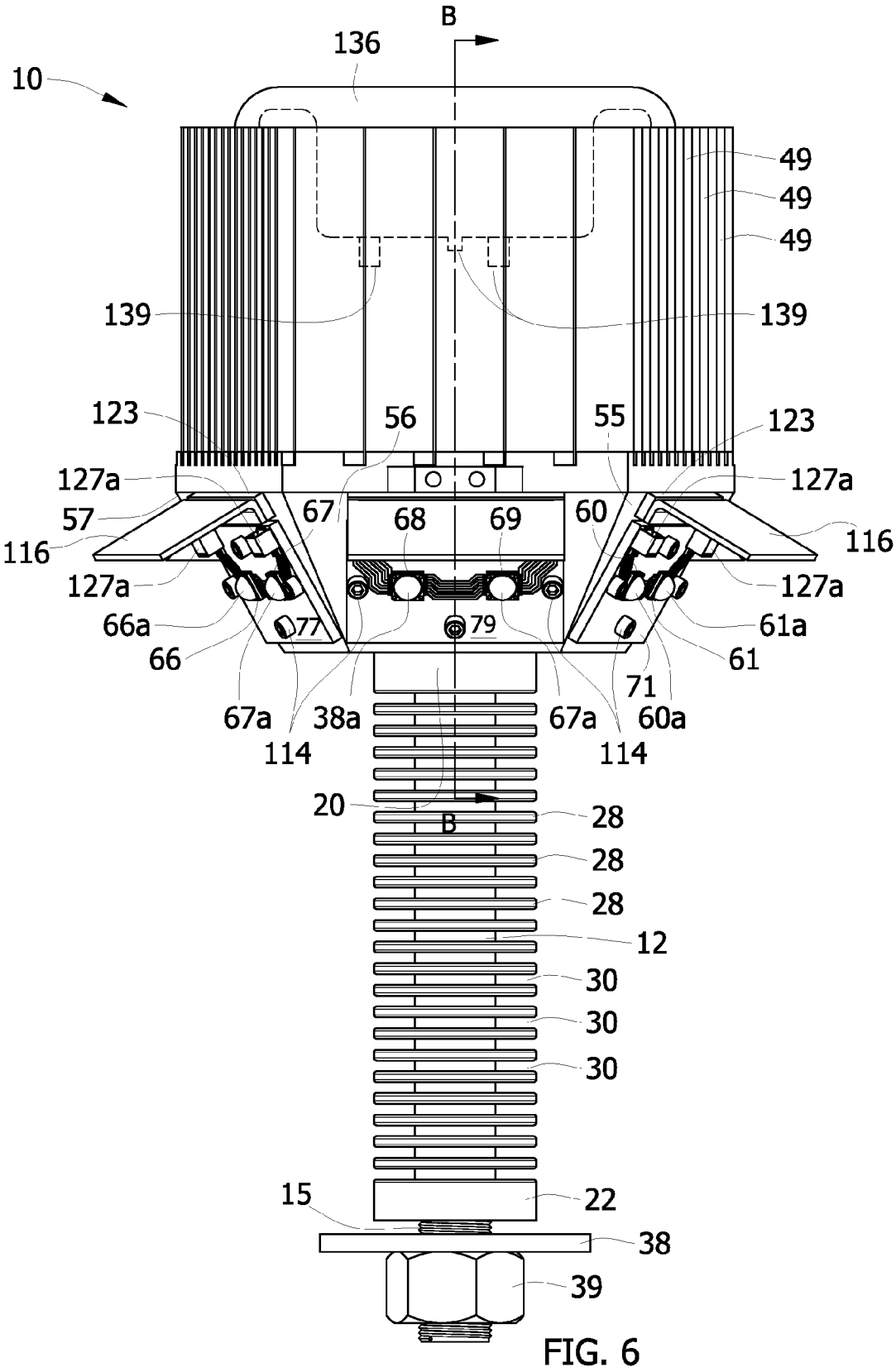
FIG. 6 is a side elevational view of a second preferred embodiment of an LED lighting module according to the invention.
Figure 7:
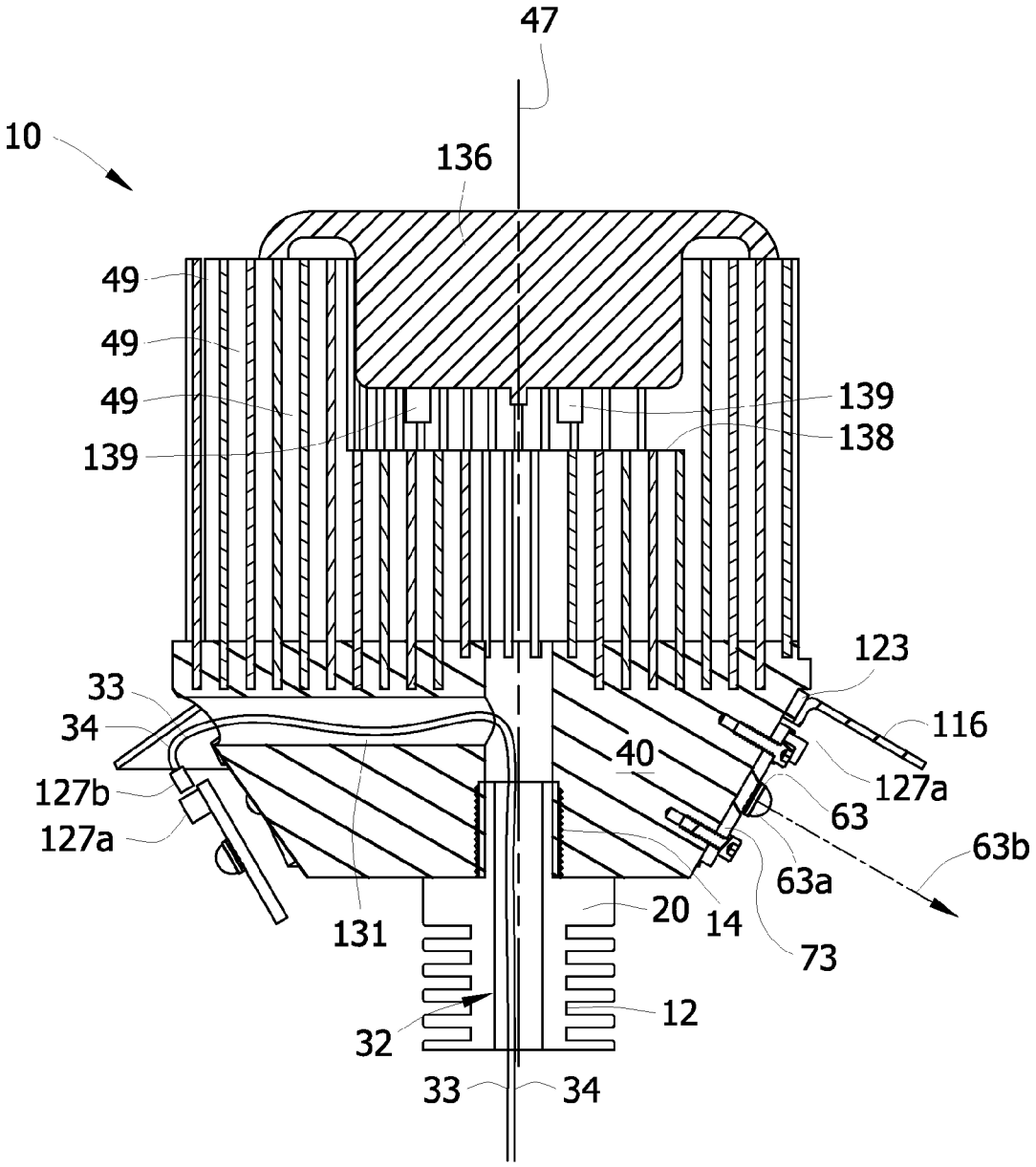
FIG. 7 is a sectional view taken along line VII-VII of FIG. 6.
Figure 8:
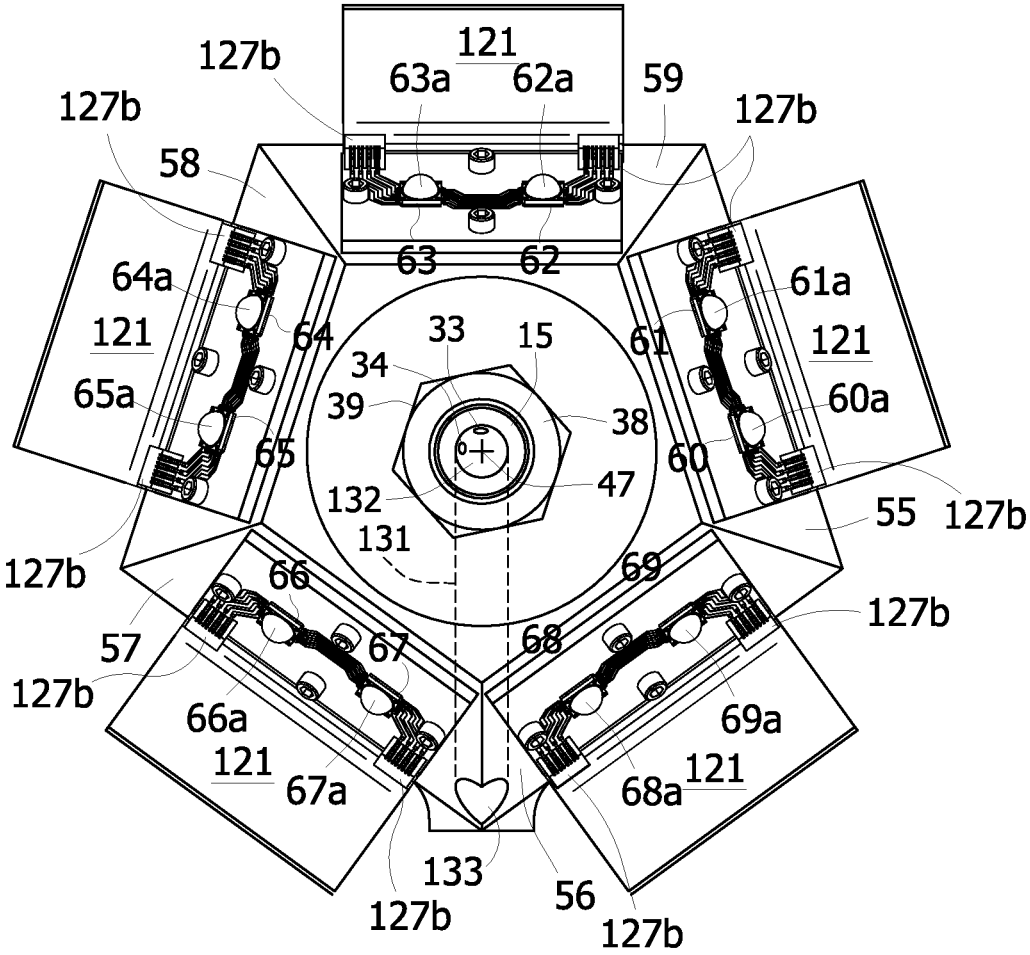
FIG. 8 is a bottom plan view of the embodiment of FIG. 5.

Thermal path 92 begins with LED 62 itself. Although at least a portion of LED 62 could if desired be supportably mounted to body 40 by mating in face-to-face contact with the facet 52 of body 40, such facial contact is neither required by the invention nor is it preferred. In the preferred embodiment, LED 62 is supportably mounted to facet 52 and thermally conductively coupled thereto by way of one or more interposed substrates, in this case, circuit board 73, which has an electrically conductive path 103 to which LED 62 is electrically and mechanically connected by wave soldering or alternative surface mount technology (SMT) as commonly employed for mounting electronic components on circuit boards in the electronics industry. As can be clearly seen from FIG. 5, circuit board 73 includes at least one, and preferably a plurality of electrically conductive paths 103 which are used to conduct electrical energy to LEDs 62 and 63 to enable them to emit a desired amount of light for a particular application. Analogous electrically conductive paths 101, 105, 107 and 109 are carried by circuit boards 71, 75, 77 and 79, respectively for conducting electrical energy to LEDs 60 and 61, 64 and 65, 66 and 67 and 68 and 69, respectively. In the preferred embodiment, electrically conductive paths 101, 103, 105, 107 and 109 each include four (4 ea.) separate circuit traces, one of which is connected to each respective one of the four (4 ea.) individual p-n junction dies associated with each of LEDs 60-69 so that all or any desired subcombination of those p-n junctions can be selectively energized or de-energized thus providing a high degree of control over both the intensity and pattern of illumination provided by module 10. Circuit boards 71, 73, 75, 77 and 79 may be mechanically and thermally conductively coupled to their respective facets 55-59 either in direct face-to-face contact or indirectly by way of one or more thin layers (not shown) of electrically insulating but thermally conductive material such as mica and/or one or more layers (not shown) of thermally conductive paste of the type described above. Circuit boards 71, 73, 75, 77 and/or 79 may also have mounted thereon, all or part of an LED driver circuit 85 for supplying sufficient electrical energy to one or more of the LEDs 60-69 to enable them to emit a desired amount of light for a particular application. Circuit boards 71, 73, 75, 77 and 79 are mechanically coupled to body 40 by cap screws 114 as shown in FIG. 5.

Figure 3:
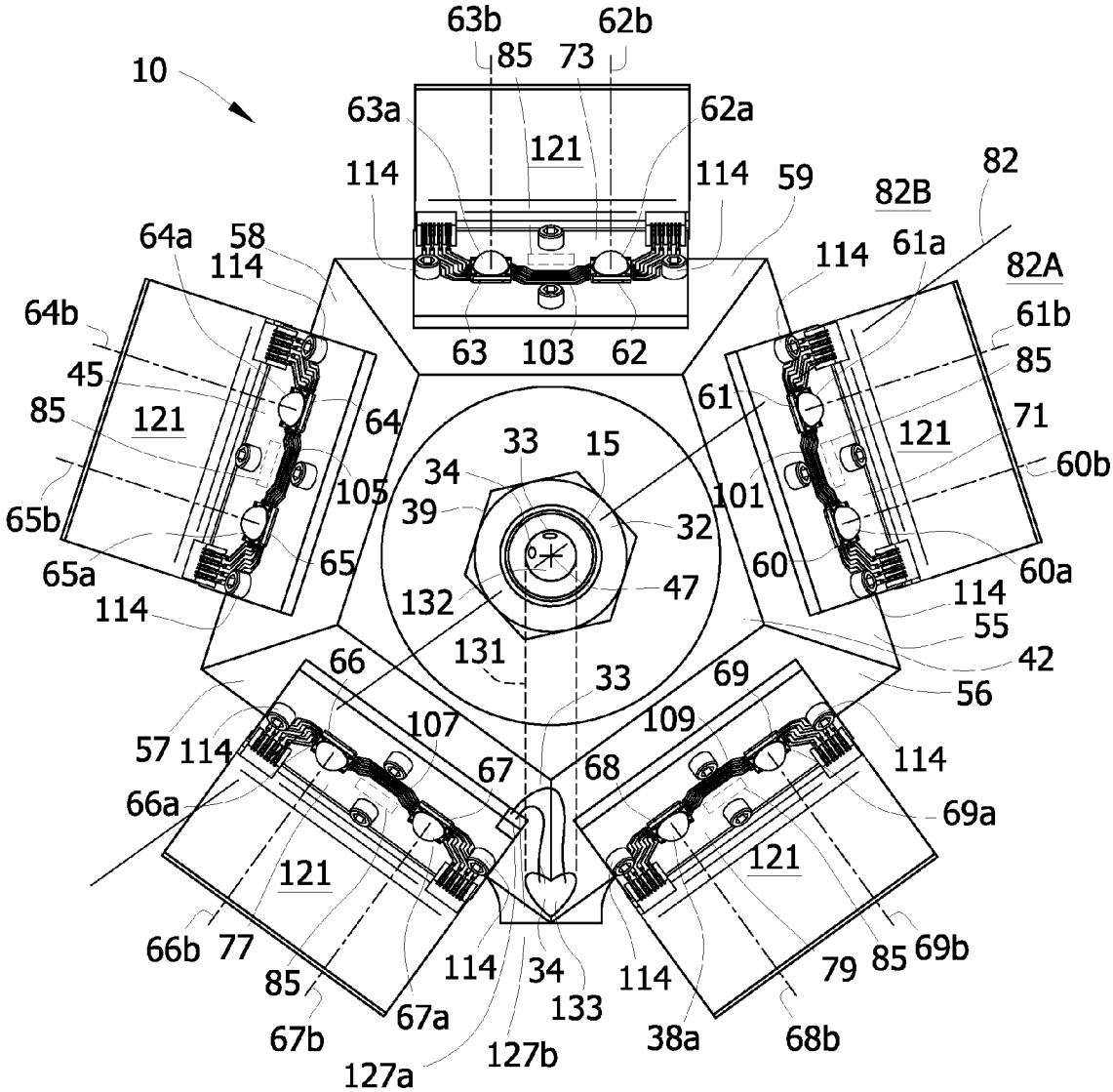
FIG. 3 is a bottom plan view of the embodiment of FIG. 1.
Figure 4:
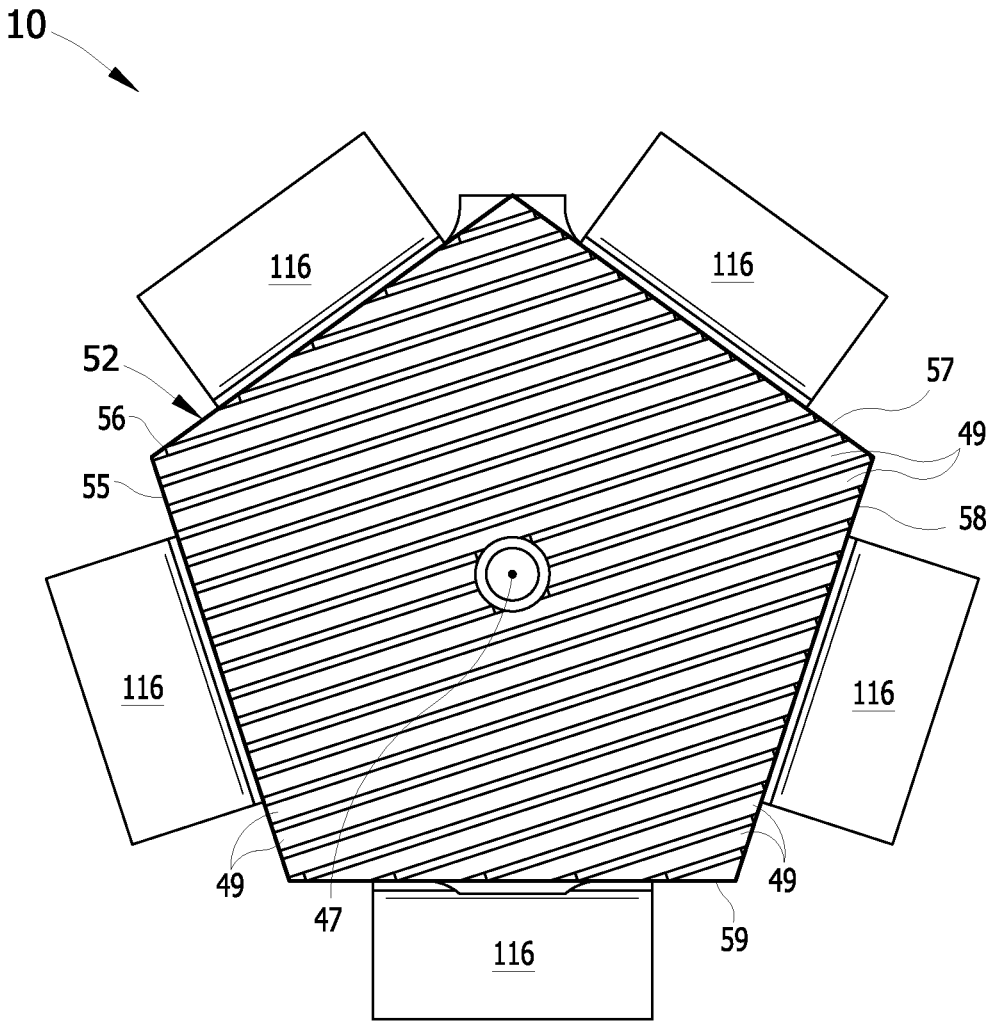
FIG. 4 is a top plan view of the embodiment of FIG. 1.

The module 10 of the preferred embodiment illustrated in FIGS. 1-5 is ideal for providing a Type V distribution pattern when LEDs 60-69 are all fully illuminated since, as illustrated in FIG. 3, module 10 can be bisected by an imaginary vertical plane 82 one side of which, 82A, will be illuminated mainly by a total of six LED's, namely LEDs 66, 67, 68, 69, 60 and 61 mounted on three facets, namely facets 57, 56 and 55. The opposite side, 82B, of plane 82 will be illuminated mainly by a total of only four LED's, namely LEDs 62, 63, 64, and 66 mounted on two facets, namely facets 57, 56 and 55 and therefore will receive less illumination, even when all of LED's 60-69 operate at full light output. Such an overall lighting distribution pattern is ideal for example for post-lights mounted between a street and sidewalk where it is frequently desirable to cast more light into the street than in the opposed direction toward the sidewalk which may adjoin a residential property. This can easily be achieved by elevated mounting of module 10 on a lamppost located beside the street in an orientation such that plane 82 is oriented generally parallel to the street with side 82A facing the street and side 82B facing the sidewalk beside the street. Those skilled in the art will immediately appreciate that by allowing for variation of the number of facets included in polygonal array 52, the value of the downward angles 124 of the facets, the number and spacing of LEDs on particular ones of the facets, the angular values of the acute angles 125 at which the respective optical axes of respective ones of those LEDs are oriented relative to mounting axis 47, the elevations of respective ones of those LEDs relative to a reference elevation 200, the invention affords great flexibility and many different lighting patterns can be provided.

In the preferred embodiment, LEDs 60-69 emit white light and each rated at about six point six Watts (6.6 W) at full output. The overall maximum rated electrical power consumption of module 10 is about sixty six watts (66 W) at one hundred twenty volts A.C. (120 VAC) and a power supply line frequency of sixty Hertz (60 Hz.). With LED's 60-69 electrically driven by an LED driver 85 such as a type LP109-36-GC-170 available from High Perfection Technology Co., Ltd of Florida module 10 is capable of delivering a total of 4273.9 lumens at an efficiency of 64.7 lumens per watt. Driver 85 may suitably comprise any one of a variety of widely commercially available LED drivers selected according to the needs of a particular application. Other suitable alternatives include without limitation a type LP1090-36-GG-170 or a type LP1090-24-GG-170, both available from Magtech Industries of Las Vegas, Nev. If desired, driver 85 may be mounted within an enclosed portion of a housing 35 of a light fixture 36 as illustrated in FIG. 2. Alternatively, all or a portion of driver 85 may be mounted on one or more of the substrates, namely circuit boards, 71, 73, 75, 77, and/or 79 as schematically illustrated in FIG. 3.

As illustrated in FIG. 2, module 10 may optionally include one or more light shields 116 which extend radially outwardly from one or more of the facets 55-59 and are positioned to prevent at least some of the light 118 emitted by at least one of LEDs 69-69 from being projected in a skyward direction so as to facilitate compliance with so-called "dark sky" regulations or standards which seek to limit skyward light emissions. For enhanced energy efficiency, light shields 116 are preferably provided with a specular reflective surface 121 which re-directs light 117 in a downward direction schematically illustrated by arrow 122 where it contributes to the level of useful illumination delivered by module 10. Light shields 116 could be of any suitable material such as a plastic provided with a metallized reflective surface 121 but are preferably fabricated as extrusions or formed from sheets of highly thermally conductive material so they may serve as heat, dissipating members which are thermally conductively coupled to polyhedral body 40 and thus help conduct heat away from body 40 and liberate it to the adjoining environment. In the preferred embodiment, light shields 116 are formed from sheets of aluminum and have highly polished anodized surfaces and are secured to body using pressure-sensitive adhesive strips 123.

As shown in FIG. 2 with reference to facet 56 and LED 63 as a typical example, each facet 55-59 is oriented at a downward angle 124 with respect to mounting axis 47 and faces outwardly away from mounting axis 47. The optical axis 60*b*-69*b* of each respective LED 60-69 is oriented at an acute angle 125 with respect to mounting axis 47. In the preferred embodiment, the downward angle 124 is preferably an angle within a range of about twenty five degrees (25°) to about thirty degrees and is most preferably about twenty nine point seven degrees (29.7°). While the downward angle 124 happens to be of the same for each of facets 55-59, such an arrangement is not essential to the invention. Any or all of facets 55-59 may be oriented with respect to mounting axis 47 at a downward angle 124 of an angular value which differs from the angular value of the downward angle 124 of the one or more of the other facets 55-59 without departing from the scope of the invention. Likewise, the acute angles 125 of optical axes 60*b*-69*b* with respect to mounting axis 47 can be, but need not necessarily be, of the same angular value for each one of LEDs 60-69 instance. In the preferred embodiment each acute angle 125 is preferably within a range of about sixty five degrees (65°) to about sixty degrees (60°) and is most preferably about sixty point three degrees (60.3°). In the preferred embodiment, downward angle 124 and acute angle 125 are complimentary angles meaning that when added together, their respective angular values total ninety degrees (90°).

Each circuit board 71, 73, 75, 77 and 79 in the preferred embodiment has mounted thereon at least one (1 ea.) first mating part 127*a* of at least one electrical connector 127 of the type which includes a first mating part 127*a* and a second mating part 127*b* which are selectively disconnectably coupleable to one another, both electrically and mechanically. Each second mating part 127*b* is electrically coupled to one or more electrically conductive traces (not shown) on the respective one of circuit boards 71, 73, 75, 77, 79 to which that mating part 127*b* is mounted for carrying control signals and/or electrical power to one or more of LEDs 60-69. Electrically connections between adjacent ones of circuit boards 71, 73, 75, 77 and 79 are made by way of ribbon cables 129 having multiple electrical conductors which terminate at respective individual poles of pairs of second mating parts 127*b*. For clarity of illustration, only one pair of second mating parts 127*b* and only one ribbon cable 129 are shown in the drawings.

As illustrated in FIG. 3, body 40 includes a second passage 131 which, in cooperation with first passage 32 serves as a conduit for routing electrical conductors 33, 34 internally through body 40 for mechanical protection and concealment. Second passage 131 has a generally radially oriented longitudinal axis which runs generally transverse to mounting axis 47 and first passage 32. Second passage 131 communicates with first passage 32 by way of a first end 132 which opens into first passage 32 and has a second end 133 which opens at the exterior surface of body 40 at a location where facets 56 and 57 intersect. Electrically conductors 33, 34 terminate with a second mating part 127*b* of the detachable connector 127 whose first mating part 127*a* is mounted to circuit board 77.

According to a second preferred embodiment as illustrated in FIGS. 6 through 9, module 10 also include an active cooling device 136 for enhancing the removal of heat from fins 49 by inducing active airflow in the vicinity of fins 49. While active cooling device 136 may suitably take the form of a motor-driven impeller, an active cooling module of the type readily commercially available from Nuventix, Inc. of Austin, Tex. under the brand name SynJet® is preferred. Active cooling device 136 is mounted in a cavity 138 formed among fins 49 at the top portion of module 10 and includes an electrically driven actuator (not shown) which creates turbulent, high-momentum air-jets which are expelled from nozzles 139. Each pulse of air creates a turbulent wake that pulls in ambient air behind it and enhances small-scale mixing and thermal transfer at the boundary layer near the heated surfaces of fins 49 thus providing high heat transfer at low-volume flow rates.

Figure 9:
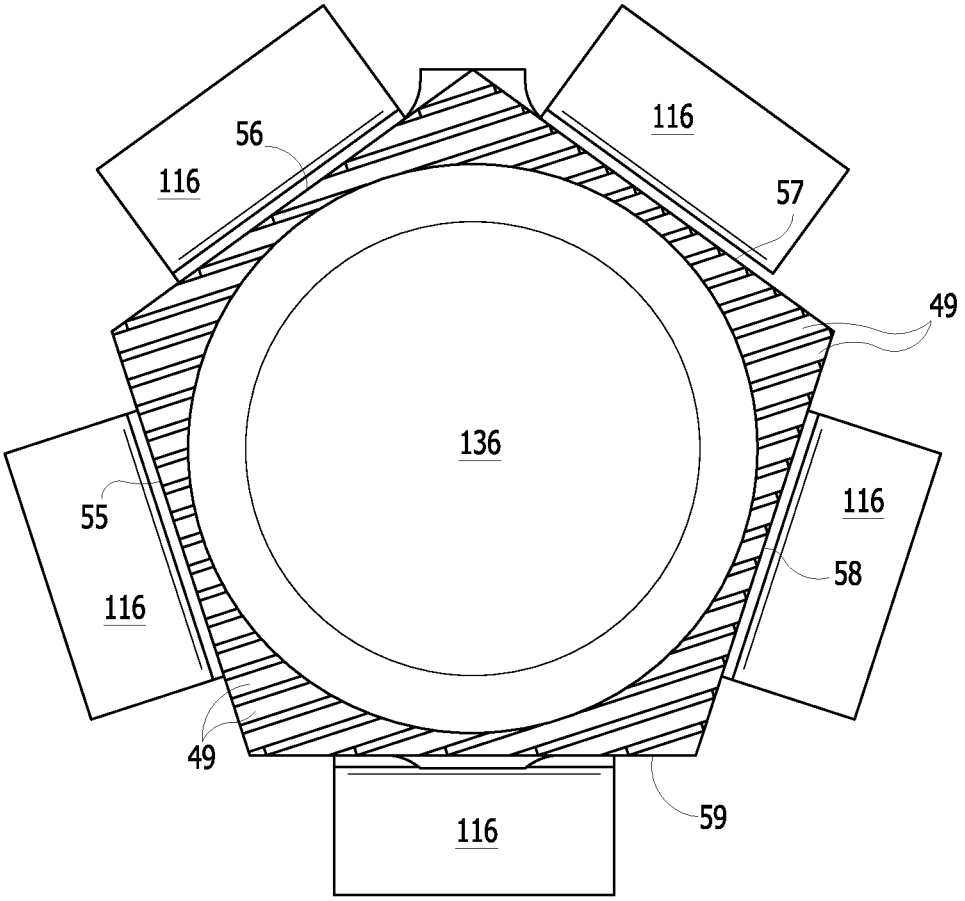
FIG. 9 is a top plan view of the embodiment of FIG. 5.
Figure 10:
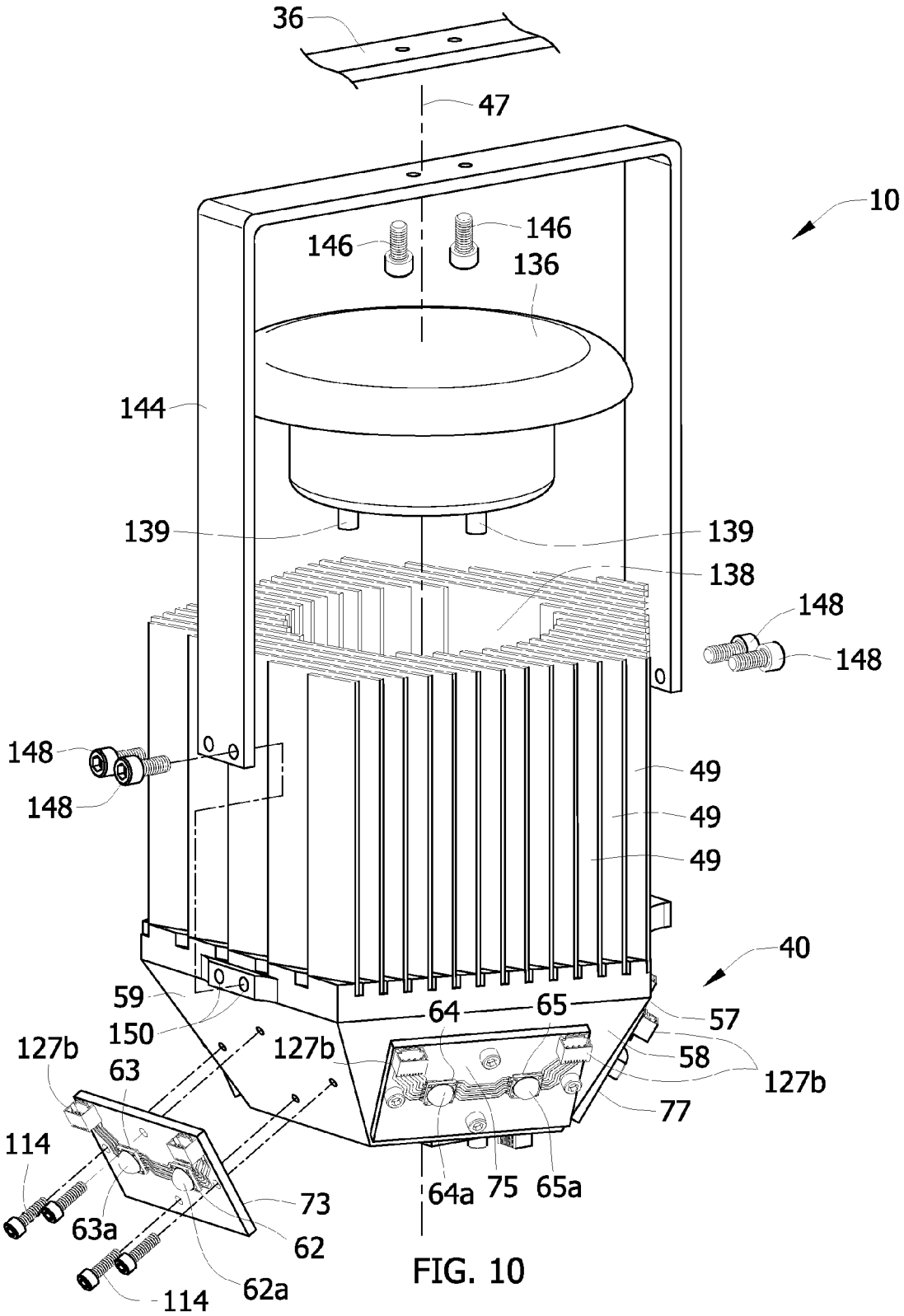
FIG. 10 is a partially exploded perspective view of a third preferred embodiment of an LED lighting module according to the present invention.
Figure 11:
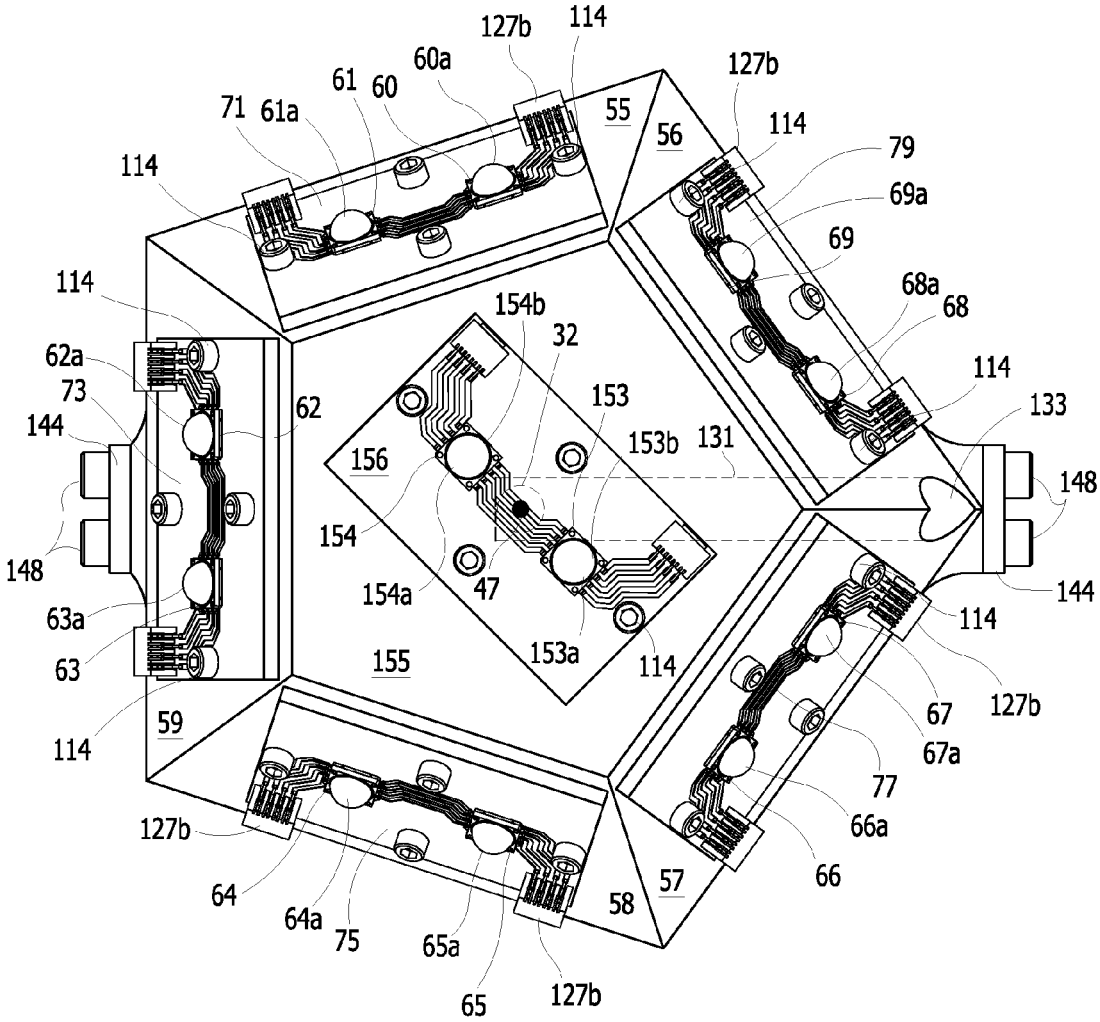
FIG. 11 is a bottom plan view of the embodiment of FIG. 10.

A third preferred embodiment of an LED lighting module 10 according to the invention is illustrated in FIGS. 10 and 11. As an option, the embodiment of FIGS. 10 and 11 includes an active cooling device 136 with nozzles 139 as described above which is mounted in a cavity 138 formed among the heat-dissipating fins 49 which are mechanically and thermally conductively coupled to polyhedral body 40. Unlike the embodiments of FIGS. 1-9, the embodiment of FIGS. 10 and 11 does not include a support post 12. Instead, module 10 is adapted to be suspended in an installed position from a light fixture 36. In the embodiment of FIGS. 10 and 11, this is achieved through use of an inverted "U"-shaped mounting bracket which is secured to fixture 36 by screws, rivets or any other suitable fastener 146 and is secured to polyhedral body 40 by cap screws 148 which penetrate mounting bracket 144 and are received in threaded holes 150 formed in body 40.

In addition to the LEDs 60-69 mounted on facets 55-59, the polyhedral body 40 of the embodiment of FIGS. 10 and 11 includes at least one additional LED, and more preferably, two additional LEDs 153, 154 which are mounted to a lower surface 155 of body 40 by way of a sixth circuit board 156.

Figure 12:
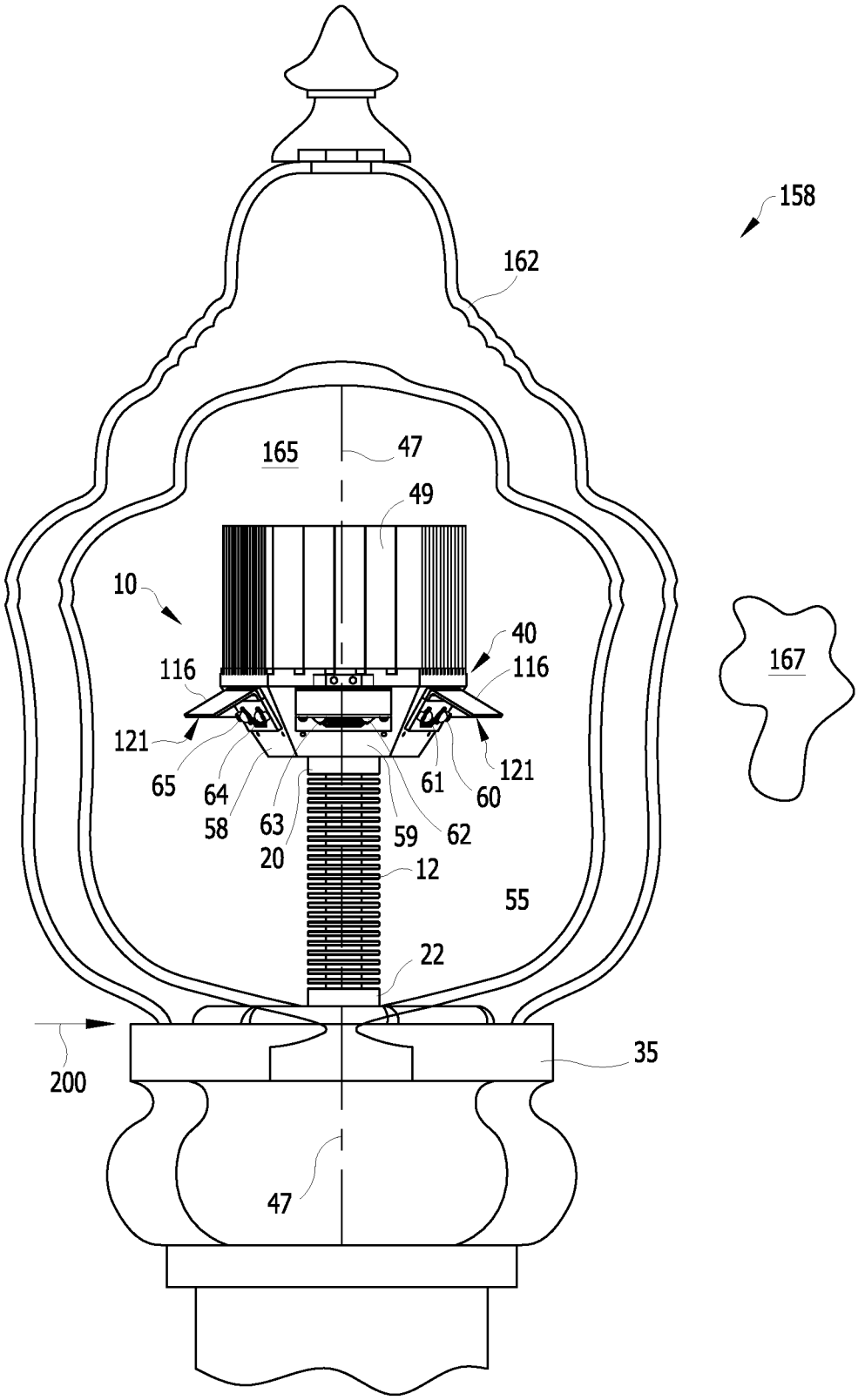
FIG. 12 is a first preferred embodiment of a luminaire according to the present invention incorporating the LED lighting module of FIG. 1.

FIG. 12 shows preferred embodiment of a luminaire 158 which incorporates an LED lighting module 10 of the type shown in FIGS. 1-5 and described in detail above with reference thereto. Module 10 is mechanically coupleable to the housing 35 of luminaire 158 by a nut 39 and washer 38 in the manner described above with reference to FIG. 2. Housing 35 is supported a height above ground level by a lamppost 160. In the preferred embodiment, the height of lamppost 160 is such that LEDs 60-69 are positioned at a height of about three meters (3 m) above ground level but it is to be understood that the height of the module 10 above ground level will vary to accommodate the needs of a particular application. Module 10 is mounted to housing 35 so that the mounting axis 47 of module 10 is oriented substantially vertically. If desired, a luminaire 158 constructed as otherwise shown in FIG. 12 may optionally be provided with an active cooling device 136 mounted at least partially within a recess 138 formed among fins 138. As a further option, one or more of the light shields 116 may be omitted if desired.

Shown partially cut away in FIG. 12, luminaire 158 includes a lens 162 which is transparent or at least partially translucent and is mechanically coupleable to housing 35 in any conventional manner. Lens 162 encloses an interior cavity 165 inside of which is located all of module 10 except the threaded lower end 15 of support 12. The heat exchanging fins 49 of body 40 and the heat exchanging fins 28 carried by support 12 are all directly exposed to the ambient environment inside interior cavity 165 which may or may not be at least partially vented by one or more openings in lens 162 itself and/or housing 35 so as to be capable of at least some air circulation between interior cavity 165 and one or more other areas such as the external ambient environment 167 outside luminaire 158 and/or spaces inside housing 35.

Lens 162 may be of any transparent or translucent material suitable for allowing at least a portion of the light energy 118 emitted from one or more LEDs 60-69 to pass through the lens 162 for illuminating an area located exteriorly of lens 162. Lens 162 can be of any of a diverse variety of materials including but not limited to a tempered or non-tempered glass, laminated or non-laminated resins or thermoplastics such as polycarbonate, polystyrene or acrylic. Lens 162 may also be of a composite of any two or more such materials, such as one having one or more layers of plastic captured between one or more layers of glass to impart resistance to shattering. For high temperature applications, or applications where lens 162 may be subjected to sudden extreme temperature changes, such as those that might occur if a lens 162 already hot from operation and/or sun exposure is suddenly sprayed with rain or a cleaning solution, a material having a low coefficient of thermal expansion can be used to avoid shattering of lens 162 due to thermal stress. Such materials include borosilicate materials such as those readily commercially available from a number of sources including for example Corning 7740 glass and others available from Corning Inc under the brand name Pyrex® and Schott Glass 8830 glass and others available from Schott Glass under the brand name Duran®.

Lens 162 may be formed using any of a variety of processes, the selection of which will depend primarily on the selection of its material and particular final shape and mechanical and optical properties desired. Glass materials are typically formed into shape by molding or casting. Thermoplastics can be processed into a desired shape in any of a variety of ways including processes such as injection molding, extrusion vacuum forming and machining. Lens 162 can also be formed by flowing a hardenable liquid material such as a mixture including a resin and a catalyst into a mold.

If desired, all or any part(s) of lens 162 can be colored or otherwise treated to alter the wavelength or other optical characteristics of the light emitted from module 10. This can be achieved for example by fabricating lens 162 from a colored material, or by adding a coloring agent to the base material from which lens 162 is to be cast or molded. It is also an option to provide the interior and/or exterior surface of lens 162 with a coating or an applied film layer which could either be clear, colored and/or if desired, have special optical characteristics. For example, such a layer or coating could optionally comprise a polarizing filter or a non-polarizing filter. In the preferred embodiment however, lens 162 is substantially clear and uncolored. It is also to be appreciated that lens 162 may optionally be etched, "frosted" or provided with any other desired surface finish or texture. Such surface finish or texture can be formed during a molding or casting process by fabricating a surface to include a surface finish or texture that is imparted directly to the lens. Alternatively, such a texture or finish can be provided by carrying out a secondary operation on all or part of an interior or exterior surface of lens 162, such as blasting a surface of lens 162 with an abrasive media, or applying a chemical etching agent to that surface, or applying a coating to the surface. Glass surfaces for example can be surface etched by applying certain acids.

Lens 162 may, if desired, be shaped or otherwise adapted to refract focus, or defocus or change the direction of the light 44 emitted from one or more of LEDs 60-69 in a particular manner and/or to alter its wavelength or other optical characteristics. However, it is to be understood that the term "lens" as used herein and in the claims can be, but is not limited to a structure capable of focusing, defocusing and/or changing the direction, wavelength, polarization or other characteristics of light, or a structure that has an axis of symmetry or has optical characteristics beyond an ability to allow at least some of the light from at least one of LEDs 60-69 to pass through at least a portion of lens 162 itself so it can illuminate an area external to lens 162.

Figure 13:
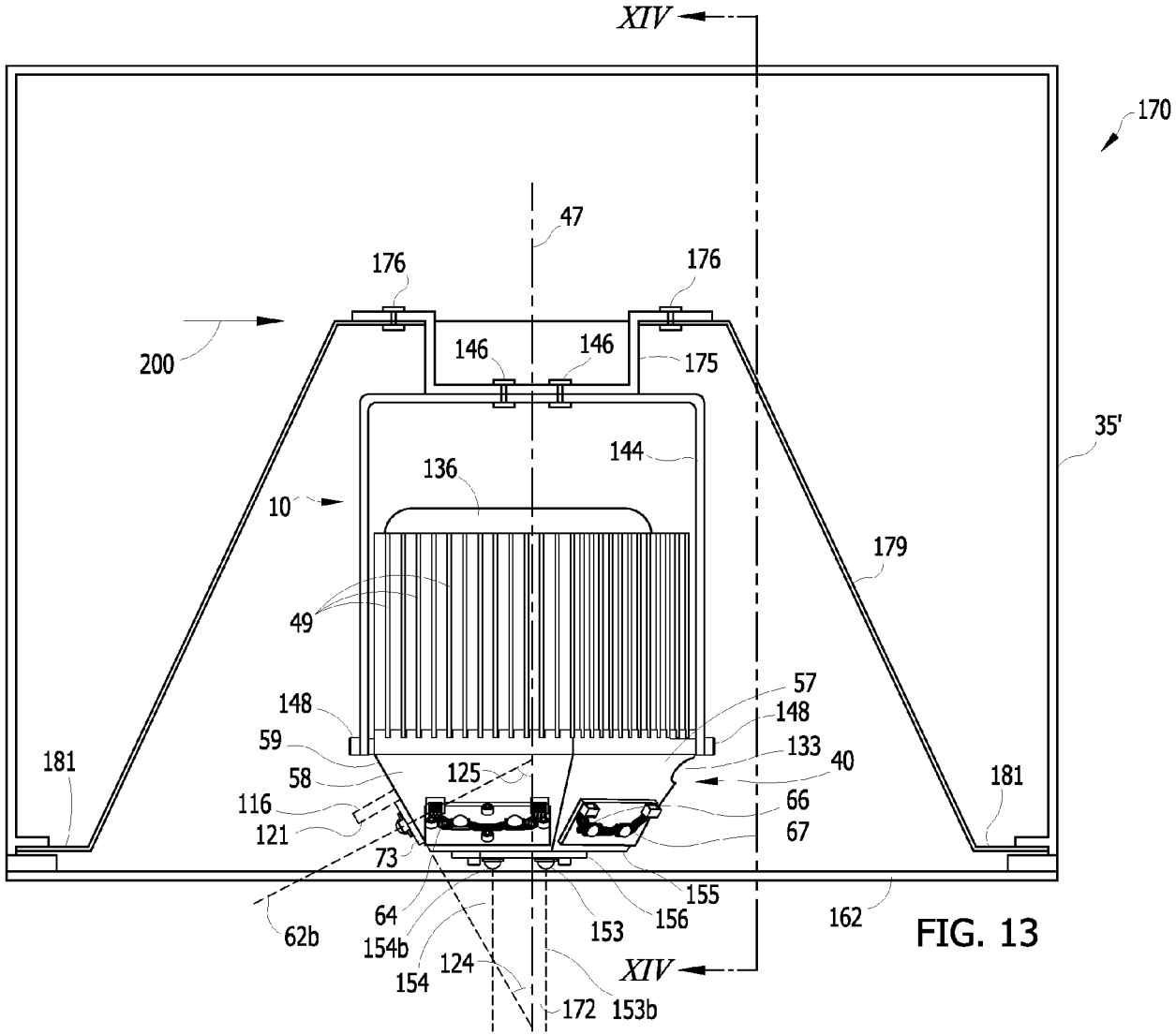
FIG. 13 is a second preferred embodiment of a luminaire according to the present invention incorporating the LED lighting module of FIG. 6.
Figure 14:
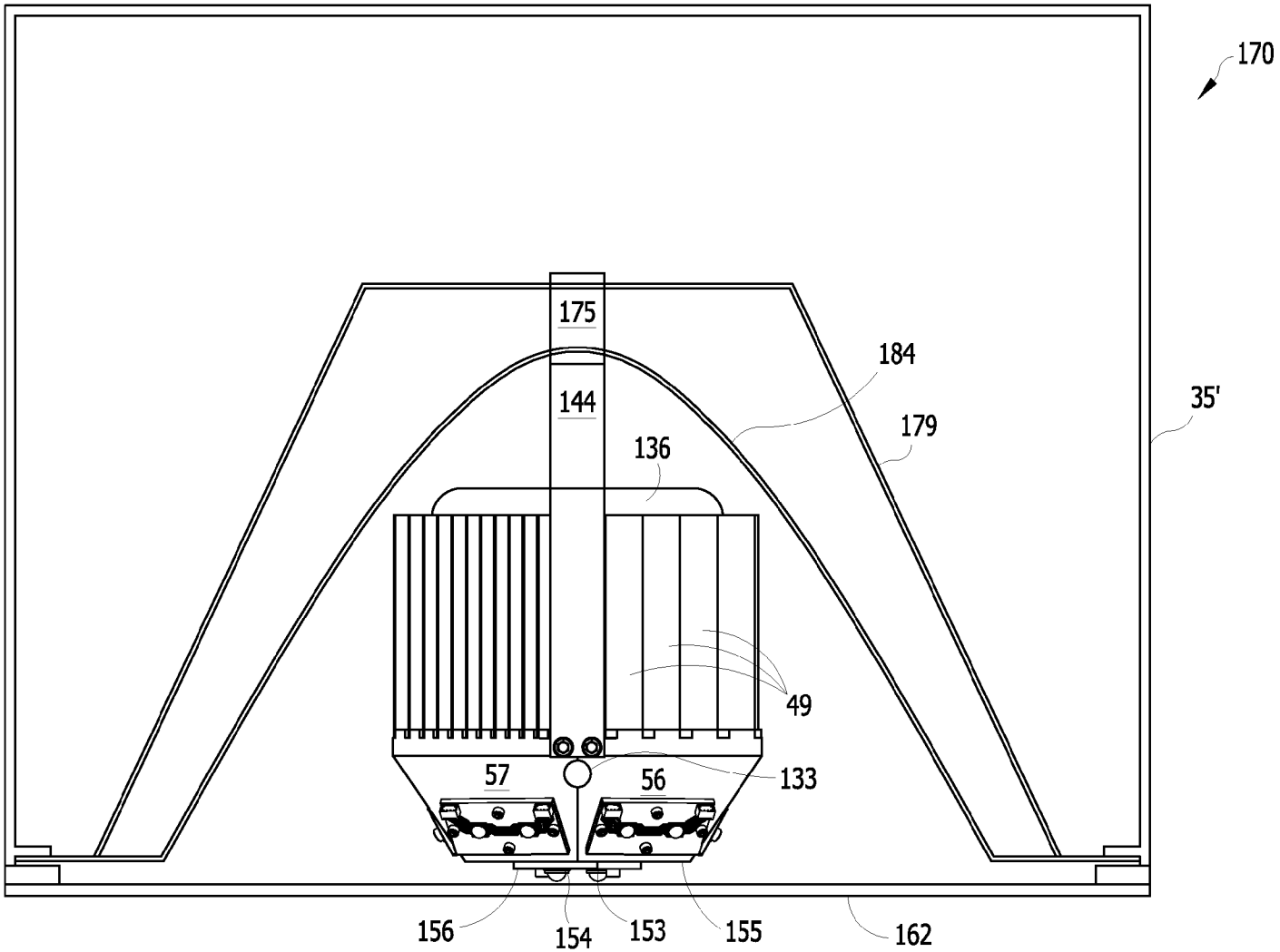
FIG. 14 is a view taken along line XIV-XIV of FIG. 13.

FIGS. 13 and 14 illustrate a preferred embodiment of a luminaire 170 which incorporates an LED lighting module 10 of the type shown in FIGS. 9 and 10 and described in detail above with reference thereto. Luminaire 170 includes an LED lighting module 10 having a polyhedral body 40 having a plurality of facets 55-59 arranged in a polyhedral array 52. Supportably mounted on facets 55-59 are respective pairs of LEDs 60-69 which are thermally conductively coupled to body 40 by way of respective circuit boards 71, 73, 75, 77 and 79. LEDs 60-69 each have respective optical axes 60*b*-69*b* which are oriented at an acute angle 125 with respect to mounting axis 47. An additional pair of LEDs 153 and 154 with respective optical axes 153*b* and 154*b* are mechanically and thermally conductively coupled to a lower surface 155 of body 40 by way of a circuit board 156. Optical axes 153*b* and 154*b* are preferably oriented parallel to mounting axis 47 or at an acute angle 172 whose angular value is less than the angular value of acute angle 125. In the preferred embodiment one or both optical axes 153*b*, 154*b* are parallel to or co-linear with mounting axis 47, so that the angular value of angle 172 is substantially zero degrees. A plurality of mutually spaced heat dissipating fins 49 are supportably mounted to and are thermally conductively coupled to body 40. Preferably, body 40 and fins 49 are formed integrally with one another and are fabricated by machining from a monolithic piece of highly thermally conductive stock or are formed together as a one-piece casting.

The embodiment of FIG. 13 optionally includes an active cooling device 136 mounted in a recess formed among fins 49. although a fan, a thermo-electric module or the like could optionally be used, active cooling device 136 is preferably of the type described above which emits a succession of turbulent air jets from nozzles which are directed at or between fins 49 to enhance the transfer of heat away from fins 49 and thus, body 40.

As illustrated in FIG. 13, body 40 is supported in an installed position relative to the housing 35 of luminaire 170 with the aid of a mounting bracket 144 which suspends module 10 inside housing 35'. Bracket 144 is mechanically coupled to body 40 by cap screws 148 and is connected by fasteners 146, such as rivets, to a support member 175 which is in turn secured by rivets or other fasteners 176 to a baffle 179. In the preferred embodiment, baffle 179 is formed of sheet metal and is shaped generally in the form of a truncated cone which widens progressively from its top to a peripheral rim 181 by way of which baffle 179 is mechanically coupled to the housing 35' of luminaire 170. As an option, lens 162' may be secured to housing 35' to enclose module 10 within housing 35'. As illustrated in FIG. 14, luminaire 170 may also optionally include a reflector 184 such as one of a parabolic shape, interposed between module 10 and baffle 179 as shown. In lieu of a reflector 184, luminaire 170 may be provided with one or more light shields 116, each having a reflective surface 121 as described in connection with FIGS. 1-5 above.

Figures 15, 16:
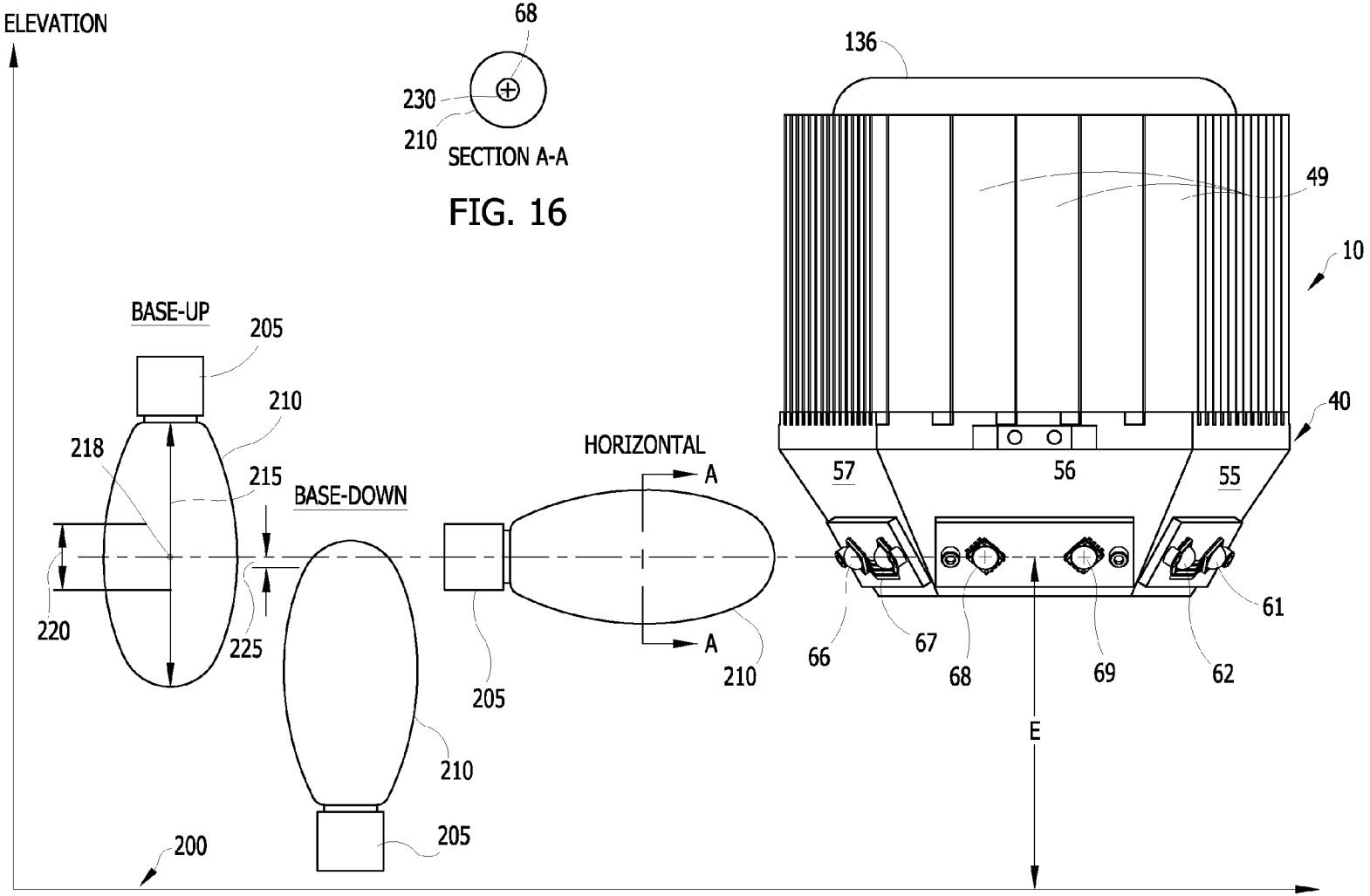
FIG. 15 is a diagram illustrating the positioning of the LEDs with reference to the mounting of the original lamp being replaced.
FIG. 16 is a schematic cross sectional view taken along line A-A of FIG. 15.

FIG. 15 is a diagram which illustrates the proper elevational positioning of LEDs 60-69 with respect to an elevation reference level 200 of a light fixture or luminaire in which an LED illumination module 10 is to be mounted. Elevation reference level 200 may be the elevation of any point or locus of points whose elevation with respect to the housing 35 or 35' of the light fixture 36, luminaire 158 or luminaire 170 remains substantially fixed after the light fixture 36 or luminaire 158 or 170 has been installed. By way of non-limiting example, an arbitrary elevation reference level 200 corresponding to the top surface of the housing 35 of the fixture 36 in FIG. 2 and the luminaire 158 in FIG. 12 and the uppermost inside surface 204 of the baffle 179 of luminaire 170 in FIG. 13.

According to the invention, the proper elevational distance, E, between at least some, and preferably all, of the LEDs 60-69 mounted to the downwardly angled and outwardly facing facets 55-59 is determined in relation to the installed elevation and orientation of the lamp or lamps which were originally present in the fixture or luminaire or for which the fixture or luminaire was originally designed to operate. Such lamp or lamps is referred to hereinafter and in the claims as the "replaced lamp" and is designated in FIG. 15 by reference numeral 203. Typically a replaced lamp 203 has a base 205 and an envelope 210 having a major dimension 215. Typically, the envelope of a replaced lamp will be of glass, quartz or other transparent or at least partially translucent crystalline material. The term "replaced lamp" is to be broadly construed to encompass any and all types of electrically powered lamps regardless of the physical process or processes by which they generate light and includes without limitation incandescent lamps, fluorescent lamps, gas discharge lamps and other types whether presently known or invented in the future. The term "replaced lamp" is also not to be limited by the shape or configuration of the replaced lamp 203 shown in FIG. 15. It is to be understood that such illustration is of a schematic nature and is only intended as an example and not a limitation.

The elevational positioning of at least some of LEDs 60-69 in applications in which module 10 is to be used to replace, or used in lieu of, a replace lamp 203*a* whose installed position is in a base-up orientation as illustrated in the left most example in FIG. 15. The body 40 of module 10 is to be supported in an installed position by support 12, or by mounting bracket 144, such that the elevational centers of at least some of LEDs 60-69 are positioned at an elevation, E, lying within a range 220 that is centered at the midpoint of the major dimension 215 of the envelope 210 of the replaced lamp 203*a* in its installed position as shown. Range 220 extends over not more than twenty five percent (25%) of the major dimension 215 of the replaced lamp 203*a*. In the case of a replaced lamp such as a straight fluorescent tube having a straight tubular envelope with a "base" at opposite ends thereof, module 10 should be elevationally positioned by treating it as a "base-up" oriented replaced lamp 203*a* if the central axis of the fluorescent tube in its installed position is vertical or within about sixty degrees (60°) of vertical. In such applications, module 10 should be elevationally positioned as just described. However, if in its installed position the angle of the tube exceeds sixty degrees (60°) from vertical, that is, if the tube is mounted with its major axis oriented horizontally or within about thirty degrees (30°) of horizontal, the module 10 should be elevationally positioned as for replacing a horizontally mounted replaced lamp 203*c*.

In applications where module 10 is to be used to replace, or used in lieu of, a base-down oriented replaced lamp 203*b*, the body 40 of module 10 is to be supported in an installed position by support 12 or bracket 144 such that the centers of at least some, and preferably all, of LEDs 60-69 are oriented at an elevation, E, which substantially corresponds to the elevation of the top of the replaced lamp 203*b* in its installed position in the light fixture 35, luminaire 158 or luminaire 170. Alternatively, the body 40 of module 10 may be supported by support 12 or mounting bracket 144 in an installed position such that at least some, and preferably all, of LEDs 60-69 are elevationally centered at an elevation, E, which lies within a range 225 which extends from about the elevation 227 of the top of the replaced lamp 203*b* in its installed position to a lower elevation 229. Lower elevation 229 is an elevation whose distance from the elevation 227 of the top of replaced lamp 203*b* in its installed position is not more than twenty five percent (25%) of the major dimension 215 of the envelope 210 of replaced lamp 203*b*.

In the case of a replaced lamp 203*c* mounted such that the central axis of envelope 210 is mounted substantially horizontally, within plus or minus fifteen degrees (15°) of horizontal support 12 or bracket 114 positions, body 40 relative to fixture 36, luminaire 158, or luminaire 170 such that the installed position of module 10 is a position at which the centers of at least some, and preferably all, of LEDs 60-69 are at an elevation, E, which substantially corresponds to the central axis 230 of replaced lamp 203*c*.

From the foregoing, it will be appreciated that because substrate 39 is thermally conductively coupled to, and located substantially immediately adjacent proximity to, LED 37 on its one side, and first heat sink 47 on it its opposite side, LED 37 and first heat sink 47 are themselves thermally conductively coupled to one another and are located substantially immediately adjacent to one another.

If module 10 is to be used in a retrofit application in place of a replaced lamp 203, the operating position and orientation of the base 205 of the replaced lamp 203 are noted prior to removal of the replaced lamp 203 from the light fixture 36 or luminaire, such as a luminaire 158 or 170, in which module 10 is to be installed. The elevational distance from the top of the envelope 210 of the replaced lamp 203 to a reference level 200 of the housing 35 of the fixture 36 or luminaire 158 or 170 is measured and recorded. Also measured and recorded are the major dimension 215 of the envelope 210 of the replaced lamp 203 and the elevation of its midpoint 218 in relation to the aforementioned midpoint 200. After removal of the replaced lamp 203 module 10 is installed to the housing 35 of the fixture 36 or luminaire 158 or the housing 35' of luminaire 170. In the case of a module 10 according to any of the embodiments of FIGS. 1 through 12, module 10 is installed in an operating position by passing the threaded lower end 39 of support 12 through a suitable opening 37 in the housing 35 and securing it in place using a nut 39 and washer 38 as illustrated in FIG. 2. After driver circuit 85 is connected to a suitable source of AC electrical power (not shown) two or more electrical conductors 33, 34 for supplying electrical energy to LEDs 60-69 are routed internally through support 12 by way of first passage 32 and internally through polyhedral body 40 by way of second passage 131. Electrical conductors 33, 34 emerge from the second end 133 of passage 131 where they terminate in a second mating part 127*b* which is disconnectably mechanically and electrically coupled to the first mating part 127*a* of at least one of the electrical connectors 127 which are in turn electrically coupled to one or more of the electrically conductive paths 101, 103, 105, 107, and 109 of circuit boards 71, 73, 75, 77 and 79, respectively.

After one or more of LEDs 60-69, and in the case on the embodiments of FIGS. 10 through 14 also LED's 153 and 154, are initially energized by driver circuit 85 by way of electrical conductors 33 and 34, the energized ones of those LEDs begin to LED emit light 118 as well as generate a substantial amount of heat. The temperatures of the energized ones of LEDs 60-69, 153 and 154 begin to rise rapidly but a large fraction of that heat is rapidly transported by thermal conduction from the LED's into highly thermally conductive polyhedral body 40 by way of one or more of thermal paths 90-99 which, as noted above in the preferred embodiments include respective ones of circuit boards 71, 73, 75, 77 and 79. Some of the heat entering polyhedral body 40 begins to be drained away from polyhedral body 40 by thermal conduction to the heat dissipating fins 49 which extend from body 40 itself, as well by way of the heat dissipating fins 28 extending from support 12. In turn, heat dissipating fins 28 and 49 liberate heat away from themselves by way of radiation and convection to adjacent air. Some heat is also liberated from body 40 by radiation emanating directly from body for zero itself.

During the thermal lag period which occurs before heat can begin to be drained away from body 40 at a rate at least as rapid as that at which heat is entering body 40, the body 40 has sufficient thermal mass and is coupled to LEDs 60-69, 153 and 154 by way of sufficiently low thermal resistance that body is able to take on heat from the energized ones of LEDs 60-69, 153 and 154 at a sufficiently rapid rate of heat flow to prevent any of LEDs 60-69, 153 and 154 from exceeding a temperature limit such as a maximum operating temperature at a particular location such as one which may be specified by the manufacturer of the LEDs. At the end of the thermal lag period, the duration of which will depend on local ambient conditions as well as the particular structure and materials of a particular embodiment, the rate at which heat is liberated from polyhedral body 40 will at least equal the rate at which polyhedral body for 40 takes on heat from the energized LEDs. While one or more LED's need not be supportably mounted to every one of downwardly angled facets 55-59 of polyhedral body 40, at least one LED is supportively mounted to each of at least a majority of the total number of such facets present in a particular embodiment thereby providing significant arcuate spreading of the illumination over the area to be illuminated while allowing flexibility to provide lower or substantially no illumination to selected arcuate regions surrounding the mounting axis of module 10.

While the invention has been described with reference to various preferred embodiments, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A light emitting diode (LED) lighting module for installation in a light fixture, said module comprising:

(a) a body of highly thermally conductive material, said body having a plurality of exterior surfaces disposed in an array around a first axis, each of said surfaces facing outwardly away from said first axis;

(b) a thermally conductive support having an first end and a second end, said first end and said second end being mutually spaced from one another along said first axis, said body being supportably mounted to said first end of said support and thermally conductively coupled to said first end of said support, said second end of said support being mechanically coupleable to the light fixture to support said body in an installed position in the light fixture;

(c) a plurality of LEDs, at least one LED of said plurality of LEDs being supportably mounted to each respective one of at least a majority of said surfaces and thermally conductively coupled to said body; and (d) a plurality of first heat dissipating fins supportably mounted to said body and thermally conductively coupled to said body, said LED's being located with respect to said first axis axially between said first heat dissipating fins and said support; and wherein said body has sufficient thermal mass and is thermally conductively coupled to each of said plurality LEDs by way of a thermal path having sufficiently low thermal resistance that during a thermal lag period which occurs under normal operating conditions after said LEDs are energized until heat can begin to be drained from said body at a rate at least as rapid as that at which heat enters said body from said plurality of LEDs, said body is capable of taking on heat from said plurality of LEDs at a sufficiently high rate of heat flow to prevent any of said plurality of LEDs from exceeding a temperature limit.

2. The LED lighting module of claim 1 wherein said surfaces are oriented at a downward angle with respect to said first axis and said downward angle is an angle within a range of about twenty five degrees (25°) to about thirty degrees (30°).

3. The LED lighting module of claim 1 wherein said surfaces are oriented at a downward angle with respect to said first axis, and said downward angle is an angle of about twenty nine point seven degrees (29.7°).

4. The LED lighting module of claim 1 wherein said surfaces are oriented at a downward angle with respect to said first axis and each of said LEDs have an optical axis which is oriented at an acute angle with respect to said first axis and wherein said downward angle and said acute angle are complementary angles.

5. The LED lighting module of claim 1 wherein each of said LEDs have an optical axis which is oriented at an acute angle with respect to said first axis and wherein said acute angle is an angle within a range of about sixty five degrees (65°) to about sixty degrees (60°).

6. The LED lighting module of claim 1 wherein each of said LEDs have an optical axis which is oriented at an acute angle with respect to said first axis and wherein said acute angle is an angle of about sixty point three degrees (60.3°).

7. The LED lighting module of claim 1 wherein said array is a pentagonal array and wherein said plurality of exterior surfaces comprises five facets.

8. The LED lighting module of claim 1 further comprising at least one light shield mounted to said body and extending outwardly therefrom, said light shield being positioned to prevent at least some of the light emitted by at least one of said LEDs from being projected skyward.

9. The LED lighting module of claim 8 wherein said light shield comprises at least one reflective surface positioned to reflect said at least some of said light downwardly.

10. The LED lighting module of claim 1 further comprising a plurality of second heat dissipating fins, said plurality of second heat dissipating fins being supportably mounted to said support, said plurality of second heat dissipating fins being thermally conductively coupled to said body by way of said support, said first heat dissipating fins and said second heat dissipating fins being located such that said first heat dissipating fins and said second heat dissipating fins are directly exposed to air when said body is in said installed position.

11. The LED lighting module of claim 1 wherein said support includes a first passage through which may be routed electrical conductors for supplying electrical energy to at least one of said LEDs.

12. The LED lighting module claim 1 wherein said second end of said support is threaded to receive a threaded fastener for mechanically coupling said second end of said support to the light fixture.

13. The LED lighting module of claim 1 wherein at least one of said LEDs is mounted supportably on a substrate, at least a portion of said substrate being interposed between said at least one of said LEDs and said body.

14. The LED lighting module of claim 13 wherein said substrate includes at least one electrically conductive path for supplying electrical energy to said at least one of said LEDs to enable said at least one of said LEDs to emit light.

15. The LED lighting module of claim 13 wherein said substrate carries a driver for electrically driving at least one of said LEDs.

16. A light emitting diode (LED) lighting module for installation in a light fixture, said module comprising:

(a) a polyhedral body of highly thermally conductive material, said body having a mounting axis and a plurality of exterior facets disposed about said mounting axis in a substantially polygonal array, each of said facets facing outwardly away from said mounting axis and at a downward angle with respect to said mounting axis;

(b) a support having an upper end and a lower end, said upper end and said lower end being mutually spaced from one another along said mounting axis, said body being supportably mounted to said upper end of said support, said lower end of said support being adapted to be mechanically coupled to the light fixture;

(c) a plurality of LEDs, at least one LED of said plurality of LEDs being supportably mounted to each respective one of at least a majority of said facets and thermally conductively coupled to said body, each of said LEDs having an optical axis oriented at an acute angle with respect to said mounting axis, at least one of said LEDs being mounted supportably on a substrate, at least a portion of said substrate being interposed between said at least one of said LEDs and said body, said substrate including at least one electrically conductive path for supplying electrical energy to said at least one of said LEDs to enable said at least one of said LEDs to emit light, said substrate having mounted thereon a first mating part of at least one electrical connector, said first mating part being electrically coupled to said electrically conductive path for supplying electrical energy to said at least one of said LEDs by way of a second mating part which is selectively disconnectably coupleable, both mechanically and electrically, to said first mating part; and (d) a plurality of heat dissipating fins supportably mounted to said body and thermally conductively coupled to said body.

17. The LED lighting module of claim 16 wherein said support includes a first passage which extends between said upper end and said lower end and wherein said body includes a second passage, said second passage communicating with said first passage and extending to an exterior opening on said body, said module further comprising at least one electrical conductor routed from at least said lower end of said support to said exterior opening by way of said first passage and said second passage, said electrical conductor being electrically coupled to said second mating part of said at least one said electrical connector.

18. A light emitting diode (LED) lighting module for installation in a light fixture, said module comprising:

(a) a body of highly thermally conductive material, said body having a plurality of exterior surfaces disposed in an array around a first axis, each of said surfaces facing outwardly away from said first axis;

(b) a thermally conductive support having a first end and a second end, said first end and said second end being mutually spaced from one another along said first axis, said body being supportably mounted to said first end of said support and thermally conductively coupled to said first end of said support, said second end of said support being mechanically coupleable to the light fixture to support said body in an installed position in the light fixture;

(c) a plurality of LEDs, at least one LED of said plurality of LEDs being supportably mounted to each respective one of at least a majority of said surfaces and thermally conductively coupled to said body; and (d) a plurality of first heat dissipating fins supportably mounted to said body and thermally conductively coupled to said body, said LED's being located with respect to said first axis axially between said first heat dissipating fins and said support; and wherein said support includes a first passage which extends between said first end and said second end and wherein said body includes a second passage, said second passage communicating with said first passage and extending to an exterior opening on said body, said module further comprising at least one electrical conductor routed from at least said second end of said support to said exterior opening by way of said first passage and said second passage for supplying electrical energy to said at least one LED to enable said LED to emit light.

19. A light emitting diode (LED) luminaire, comprising:

(a) a housing;

(b) a lens mechanically coupleable to said housing, said lens having an interior cavity;

(c) a body of highly thermally conductive material, said body having a plurality of exterior surfaces disposed in an array around a first axis, each of said surfaces facing outwardly away from said first axis;

(d) a thermally conductive support having a first end and a second end, said first end and said second end being mutually spaced from one another along said axis, said body being supportably mounted to said first end of said support and thermally conductively coupled to said first end of said support, said second end of said support being mechanically coupled to said housing to support said body inside said interior cavity of said lens;

(e) a plurality of LEDs, at least one LED of said plurality of LEDs being supportably mounted to each respective one of at least a majority of said surfaces, each of said LEDs being thermally conductively coupled to said body; and (f) a plurality of first heat dissipating fins supportably mounted to said body and thermally conductively coupled to said body, said LEDs being located with respect to said first axis axially between said first heat dissipating fins and said support; and wherein said body has sufficient thermal mass and is thermally conductively coupled to each of said plurality LEDs by way of a thermal path having sufficiently low thermal resistance that during a thermal lag period which occurs under normal operating conditions after said LEDs are energized until heat can begin to be drained from said body at a rate at least as rapid as that at which heat enters said body from said plurality of LEDs, said body is capable of taking on heat from said plurality of LEDs at a sufficiently high rate of heat flow to prevent any of said plurality of LEDs from exceeding a temperature limit.

20. The LED luminaire of claim 19 wherein said surfaces are oriented at a downward angle with respect to said first axis and said downward angle is an angle within a range of about twenty five degrees (25°) to about thirty degrees (30°).

21. The LED luminaire of claim 19 wherein said surfaces are oriented at a downward angle with respect to said first axis and said downward angle is an angle of about twenty nine point seven degrees (29.7°).

22. The LED luminaire of claim 19 wherein said surfaces are oriented at a downward angle with respect to said first axis and each of said LEDs has an optical axis which is oriented at an acute angle with respect to said first axis and wherein said downward angle and said acute angle are complementary angles.

23. The LED luminaire of claim 21 wherein said acute angle is an angle within a range of about sixty five degrees (65°) to about sixty degrees (60°).

24. The LED luminaire of claim 23 wherein said acute angle is an angle of about sixty point three degrees (60.3°).

25. The LED luminaire of claim 19 wherein said array is a pentagonal array and wherein said plurality of exterior surfaces comprises five facets.

26. The LED luminaire of claim 19 further comprising at least one light shield mounted to said body and extending outwardly therefrom, said light shield being positioned to prevent at least some of the light emitted by at least one of said LEDs from being projected skyward.

27. The LED luminaire of claim 26 wherein said light shield comprises at least one reflective surface positioned to reflect said at least some of said light downwardly.

28. The LED luminaire of claim 19 further comprising a second plurality of second heat dissipating fins, said plurality of second heat dissipating fins being supportably mounted to said support, said plurality of second heat dissipating fins being thermally conductively coupled to said body by way of said support, said first heat dissipating fins and said second heat dissipating fins being located such that said first heat dissipating fins and said second heat dissipating fins are directly exposed to air when said body is in said installed position.

29. The LED luminaire of claim 19 wherein said support includes a first passage through which one or more wires are routed for supplying electrical energy to said LEDs.

30. The LED luminaire of claim 19 wherein said second end of said support is threaded to receive a threaded fastener for mechanically coupling said second end of said support to the housing.

31. The LED luminaire of claim 19 wherein at least one of said LEDs is mounted supportably on a substrate, at least a portion of said substrate being interposed between said LED and said body.

32. The LED luminaire of claim 31 wherein said substrate includes at least one electrically conductive path for supplying electrical energy to said LED to enable said LED to emit light.

33. The LED luminaire of claim 19 wherein said substrate carries a driver for electrically driving at least one of said LEDs.

34. A light emitting diode (LED) luminaire, comprising:

(a) a housing;

(b) a lens mechanically coupleable to said housing, said lens having an interior cavity;

(c) a polyhedral body of highly thermally conductive material, said body having a mounting axis and a plurality of exterior facets disposed about said mounting axis in a substantially polygonal array, each of said facets facing outwardly away from said mounting axis and at a downward angle with respect to said mounting axis;

(d) a plurality of heat dissipating fins supportably mounted to said body and thermally conductively coupled to said body;

(e) a support having an upper end and a lower end, said upper end and said lower end being mutually spaced from one another along said mounting axis, said body being supportably mounted to said upper end of said support, said lower end of said support being adapted to be mechanically coupled to said housing to support said body in an installed position inside said interior cavity of said lens; and (f) a plurality of LEDs, at least one LED of said plurality of LEDs being supportably mounted to each respective one of at least a majority of said facets, each of said LEDs being thermally conductively coupled to said body, each of said LEDs having an optical axis oriented at an acute angle with respect to said mounting axis, at least one of said LEDs being mounted supportably on a substrate, at least a portion of said substrate being interposed between said LED and said body, said substrate including at least one electrically conductive path for supplying electrical energy to said LED to enable said LED to emit light, said substrate having mounted thereon a first mating part of at least one electrical connector, said first mating part being electrically coupled to said electrically conductive path for supplying electrical energy to said LED by way of a second mating part which is selectively disconnectably coupleable, both mechanically and electrically, to said first mating part.

35. The LED lighting module of claim 34 wherein said support includes a first passage which extends between said upper end and said lower end and wherein said body includes a second passage, said second passage communicating with said first passage and extending to an exterior opening on said body, said module further comprising at least one electrical conductor routed from at least said lower end of said support to said exterior opening by way of said first passage and said second passage, said electrical conductor being electrically coupled to said second mating part of said at least one said electrical connector for supplying electrical energy to said at least one LED for enabling said at least one LED to emit light.

36. A light emitting diode (LED) luminaire, comprising:

(a) a housing;

(b) a lens mechanically coupleable to said housing, said lens having an interior cavity;

(c) a body of highly thermally conductive material, said body having a plurality of exterior surfaces disposed in an array around a first axis, each of said surfaces facing outwardly away from said first axis;

(d) a thermally conductive support having an first end and a second end, said first end and said second end being mutually spaced from one another along said axis, said body being supportably mounted to said first end of said support and thermally conductively coupled to said first end of said support, said second end of said support being mechanically coupled to said housing to support said body inside said interior cavity of said lens; and (e) a plurality of LEDs, at least one LED of said plurality of LEDs being supportably mounted to each respective one of at least a majority of said surfaces, each of said LEDs being thermally conductively coupled to said body; and (f) a plurality of first heat dissipating fins supportably mounted to said body and thermally conductively coupled to said body, said LEDs being located with respect to said first axis axially between said first heat dissipating fins and said support and; wherein said support includes a first passage which extends between said first end and said second end and wherein said body includes a second passage, said second passage communicating with said first passage and extending to an exterior opening on said body, said module further comprising at least one electrical conductor routed from at least said second end of said support to said exterior opening by way of said first passage and said second passage for supplying electrical energy to said at least one LED for enabling said at least one LED to emit light.

* * * * *